US012264561B2

(12) United States Patent
Roberts et al.

(10) Patent No.: US 12,264,561 B2
(45) Date of Patent: Apr. 1, 2025

(54) PERFORATING GUN

(71) Applicant: Halliburton Energy Services, Inc., Houston, TX (US)

(72) Inventors: Courtney Ann Thain Roberts, Alvarado, TX (US); Cynthia Anne Kane, Alvarado, TX (US); Kevin Cook, Alvarado, TX (US); Wesley N. Ludwig, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/501,710

(22) Filed: Nov. 3, 2023

(65) Prior Publication Data

US 2024/0287879 A1 Aug. 29, 2024

Related U.S. Application Data

(60) Provisional application No. 63/447,804, filed on Feb. 23, 2023.

(51) Int. Cl.
*E21B 43/119* (2006.01)
*E21B 43/116* (2006.01)

(52) U.S. Cl.
CPC ..... *E21B 43/119* (2013.01); *E21B 43/116* (2013.01)

(58) Field of Classification Search
CPC ..... E21B 43/11; E21B 43/116
See application file for complete search history.

(56) References Cited

U.S. PATENT DOCUMENTS 4,703,986 A * 11/1987 McCormick ..... H01R 13/633 439/607.52
4,778,404 A * 10/1988 Pass ..... H01R 13/2428 439/948

(Continued)

FOREIGN PATENT DOCUMENTS

CN 113669035 A 11/2021
DE 102021108869 11/2021

(Continued)

OTHER PUBLICATIONS

International Search Report and Written Opinion for International Patent Application No. PCT/US2023/083902 dated Apr. 18, 2024. PDF file. 10 pages.

(Continued)

*Primary Examiner* — Nicole Coy
*Assistant Examiner* — Nicholas D Wlodarski
(74) *Attorney, Agent, or Firm* — John Wustenberg; C. Tumey Law Group PLLC

(57) ABSTRACT

In general, in one aspect, embodiments relate to a perforating gun that includes a gun body, a bulkhead assembly for coupling the perforating gun to an uphole perforating gun, where the bulkhead assembly is at least partially disposed in the gun body, and where the bulkhead assembly includes a bulkhead and electrical feedthrough formed in the bulkhead, and a charge tube assembly attached to the bulkhead assembly, where the charge tube is disposed in the gun body, and where the charge tube assembly includes a charge tube, a detonator housing interlocked with the charge tube, an end alignment interlocked with the charge tube, and a detonation cord extending from the detonator housing to the charge tube.

20 Claims, 29 Drawing Sheets

(56) References Cited

U.S. PATENT DOCUMENTS

| | | | | |
|---|---|---|---|---|
| 5,775,419 | A | 7/1998 | Gramlich | |
| 6,059,595 | A * | 5/2000 | Lacrouts-Cazenave | H01R 13/05 439/289 |
| 6,112,813 | A | 9/2000 | Head | |
| 6,783,405 | B1 | 8/2004 | Yen | |
| 7,121,340 | B2 | 10/2006 | Grove et al. | |
| 7,197,985 | B2 | 4/2007 | Markel et al. | |
| 8,286,697 | B2 | 10/2012 | Evans et al. | |
| 8,347,963 | B2 | 1/2013 | Johnson et al. | |
| 8,555,764 | B2 | 10/2013 | Le et al. | |
| 8,939,802 | B2 * | 1/2015 | Hara | H01R 13/05 439/867 |
| 8,978,749 | B2 | 3/2015 | Rodgers et al. | |
| 9,523,265 | B2 | 12/2016 | Upchurch et al. | |
| 9,605,937 | B2 | 3/2017 | Eitschberger et al. | |
| 10,507,433 | B2 | 12/2019 | Eitschberger et al. | |
| 10,669,821 | B2 | 6/2020 | Knight et al. | |
| 11,078,761 | B2 | 8/2021 | Grove et al. | |
| 11,098,563 | B1 | 8/2021 | Ludwig | |
| 11,299,967 | B2 | 4/2022 | Bradley et al. | |
| 11,313,208 | B2 | 4/2022 | Hoelscher et al. | |
| 11,359,468 | B2 | 6/2022 | Roberts et al. | |
| 11,547,976 | B2 | 1/2023 | Ledwon et al. | |
| 11,560,778 | B2 | 1/2023 | Grove et al. | |
| 11,608,720 | B2 | 3/2023 | Preiss et al. | |
| 2003/0047313 | A1 | 3/2003 | Wehunt, Jr. | |
| 2004/0216633 | A1 | 11/2004 | Kash | |
| 2004/0216866 | A1 | 11/2004 | Barlow et al. | |
| 2007/0084336 | A1 | 4/2007 | Neves | |
| 2007/0107589 | A1 | 5/2007 | Rospek et al. | |
| 2007/0119327 | A1 | 5/2007 | Myers, Jr. et al. | |
| 2010/0227514 | A1 | 9/2010 | Rikimaru et al. | |
| 2011/0042089 | A1 | 2/2011 | Chang et al. | |
| 2011/0127045 | A1 | 6/2011 | Spence et al. | |
| 2014/0065351 | A1 | 3/2014 | Cordner et al. | |
| 2014/0260591 | A1 | 9/2014 | Rodgers et al. | |
| 2017/0145798 | A1 | 5/2017 | Robey et al. | |
| 2017/0275974 | A1 * | 9/2017 | Von Kaenel | E21B 43/119 |
| 2018/0195372 | A1 | 7/2018 | Robey et al. | |
| 2020/0024935 | A1 | 1/2020 | Eitschberger et al. | |
| 2020/0048996 | A1 * | 2/2020 | Anthony | E21B 43/119 |
| 2020/0072029 | A1 * | 3/2020 | Anthony | E21B 43/117 |
| 2020/0200516 | A1 | 6/2020 | Zemla et al. | |
| 2020/0248535 | A1 | 8/2020 | Goyeneche | |
| 2020/0256166 | A1 | 8/2020 | Knight et al. | |
| 2020/0256168 | A1 * | 8/2020 | Knight | E21B 43/119 |
| 2020/0392819 | A1 | 12/2020 | Robey et al. | |
| 2021/0172298 | A1 * | 6/2021 | Knight | E21B 43/1185 |
| 2021/0222525 | A1 | 7/2021 | Dyess et al. | |
| 2021/0277752 | A1 | 9/2021 | Eitschberger | |
| 2021/0332678 | A1 | 10/2021 | Anthony et al. | |
| 2021/0355797 | A1 * | 11/2021 | Roberts | E21B 43/116 |
| 2021/0396103 | A1 | 12/2021 | MacGillivray et al. | |
| 2022/0010660 | A1 | 1/2022 | Dyess et al. | |
| 2022/0018226 | A1 | 1/2022 | Wells et al. | |
| 2022/0127935 | A1 | 4/2022 | Grove et al. | |
| 2022/0145732 | A1 * | 5/2022 | Anthony | E21B 43/119 |
| 2022/0186588 | A1 | 6/2022 | Shelton et al. | |
| 2022/0282600 | A1 | 9/2022 | Dyess et al. | |
| 2023/0184066 | A1 | 6/2023 | Hoelscher et al. | |

FOREIGN PATENT DOCUMENTS

| | | | |
|---|---|---|---|
| WO | 2016118179 | A1 | 7/2016 |
| WO | 2021198145 | A1 | 10/2021 |
| WO | 2022184731 | A1 | 9/2022 |

OTHER PUBLICATIONS

International Search Report and Written Opinion for International Patent Application No. PCT/US2023/080589 dated Mar. 19, 2024. PDF file. 10 pages.

International Search Report and Written Opinion for International Patent Application No. PCT/US2023/080587 dated Mar. 19, 2024. PDF file. 8 pages.

Halliburton Energy Services, Inc., Velocity Perforating System, Plug and Play guns for pumpdown operations, H012844WP, Mar. 2021.

Halliburton Energy Services, Inc., Velocity Aligned Gun System, H014094, Feb. 2023.

Halliburton Energy Services, Inc., Velocity Revolve Gun System, H014095, Feb. 2023.

Halliburton Energy Services, Inc., Velocity Perforating System, H012737, Dec. 2017.

* cited by examiner

PERFORATING GUN

CROSS-REFERENCE TO RELATED APPLICATIONS

The present application is a nonprovisional patent application claiming priority to U.S. Provisional Patent Application No. 63/447,804 filed Feb. 23, 2023, the entirety of which is herein incorporated by reference.

BACKGROUND

Wells are often drilled to extract hydrocarbons, such as oil and gas. After drilling a wellbore that traverses a hydrocarbon-bearing formation, a casing string is installed to reinforce portions of the wellbore. A casing string comprises large diameter metal tubulars that are connected end-to-end, lowered into the wellbore, and cemented in place. The casing string increases the integrity of the wellbore and provides a structure for supporting other wellbore equipment such as production tubing used for producing fluids from one or production zones of the formation to surface. When a production zone is lined with casing, the casing is perforated to allow the formation fluids to enter the wellbore. These perforations are hydraulic openings that extend through the casing and into the surrounding formation.

Typically, perforations are created by lowering a perforating gun string downhole and detonating a series of explosive shaped charges adjacent to the production zone. For safety, perforating guns may be transported to a wellsite in a partially unassembled state to prevent accidental detonation. Once fully assembled at the wellsite, a perforating gun string may be lowered into the cased wellbore on an appropriate conveyance, such as a wireline. An explosive train is then initiated to detonate the shaped charges in a predetermined, serial fashion. The perforating gun string may then be retrieved to the surface. Common problems associated with these perforating gun strings may include, for example, occasional failure detonation after lowering of the perforating gun string to its target depth, poor ergonomics of assembly of the perforating guns, and high cost of manufacturing.

BRIEF DESCRIPTION OF THE DRAWINGS

These drawings illustrate certain aspects of some of the embodiments of the present disclosure and should not be used to limit or define the method.

DETAILED DESCRIPTION

The disclosure is directed to a perforating gun assembly used during perforation of wellbore casings for hydrocarbon recovery, and more particularly, this disclosure relates to a perforating gun that includes a bulkhead, an electrical feed-through, a charge tube, an end alignment, and a detonator housing (i.e., "det sleeve" or "det housing"). The present disclosure may address reliability issues, provide designs that may reduce cost and may improve the ergonomics of the assembly during manufacture of, as well as on-site make-up of the perforating gun assembly. These features include, for example, an electrical contact device (i.e., "electrical contact"), interlocking joining features, and a skeletonized body to aid in material reduction while not compromising integrity of the various parts. Also disclosed is a connector of a perforating gun system, as well as a detonator stop and detonating cord stop for allowing an assembler to locate the appropriate insertion depth of the detonation cord during assembly of the perforating gun(s). The features disclosed herein may, in some examples, address the various problems identified by this disclosure, namely, detonation failure, poor ergonomics of assembly, and high cost of manufacturing. Specifically, the interlocking joining features may remove or reduce the need for external fasteners (i.e., screws), and the choice of material as well as skeletonization of the various components may reduce the cost of manufacturing. In addition, a grounding clip may also mitigate to some degree risk of detonation failure by improving grounding of various components and preventing build-up of electric charge of one or more components, and side-by-side detonation of a detonating cord and a detonator may also ensure more reliable detonation.

Figure 1:
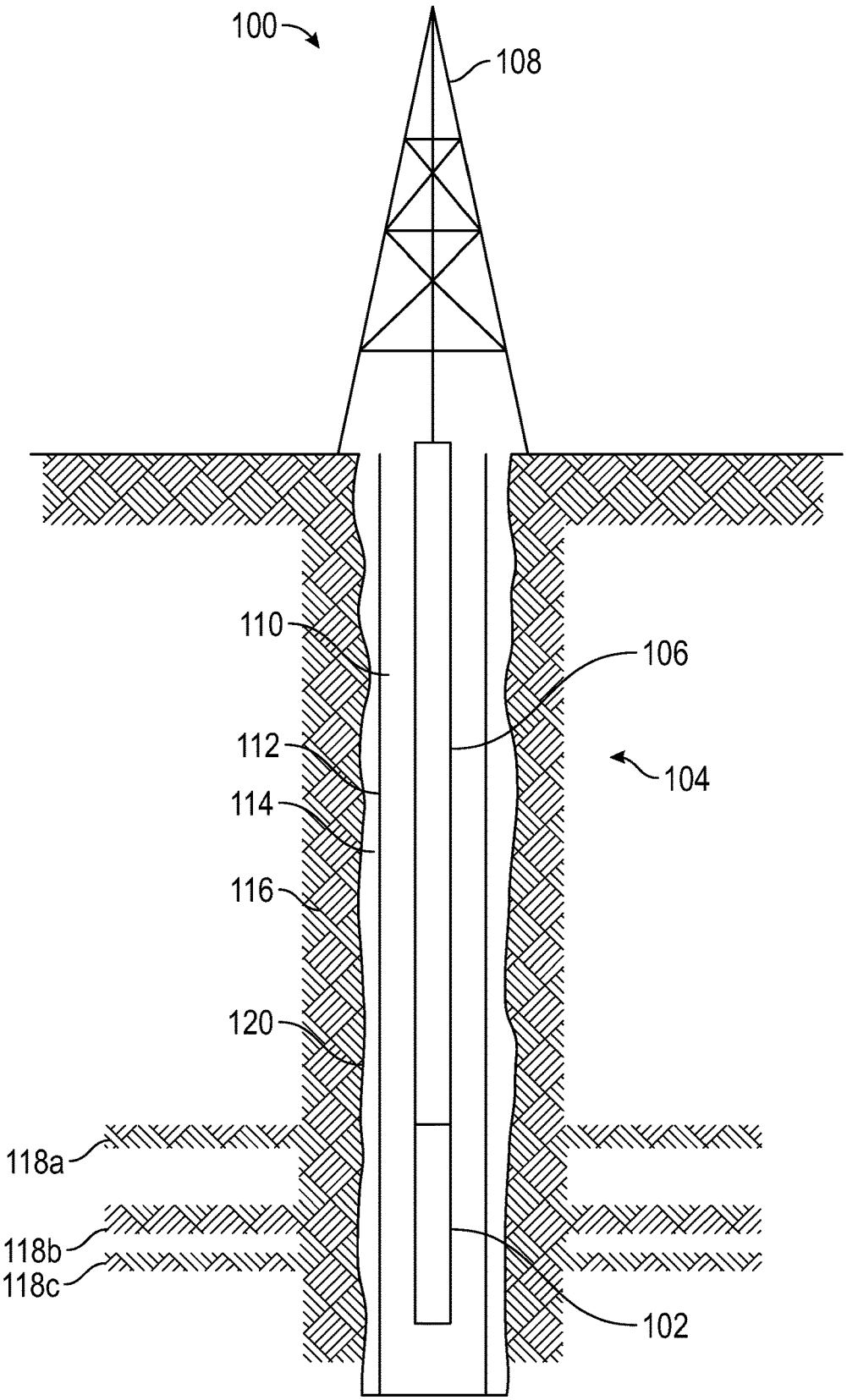
FIG. 1 is a system showing a perforating gun in a wellbore during a land-based operation, in accordance with some examples of the present disclosure.

FIG. 1 is a system 100 showing a perforating tool assembly 102 in a wellbore 110 during a land-based operation. The system 100 comprises a servicing rig 108 disposed on a terrestrial surface over a wellbore 110 extending into subterranean formation 116. Wellbore 110 may be vertical, deviated, horizontal, and/or curved at one or more regions of subterranean formation 116. Wellbore 110 may be cased, open hole, contain tubing, and may generally comprise a hole in the ground, i.e., "borehole", extending any appropriate distance into subterranean formation 116. In one or more examples, one or more regions of the wellbore 110 may be secured at least in part by cement 114.

Servicing rig 108 may be a drilling rig, completion rig, workover rig, or other mast structure supporting work string 104. In some examples, servicing rig 108 comprises a derrick and rig floor through which work string 104 extends downwards into wellbore 110. As will be shown in FIG. 2, a wellbore may be alternatively positioned in a sea-based environment, such as on a semi-submersible platform or rig, or otherwise disposed above a sea floor at an off-shore location.

As illustrated, work string 104 may comprise a conveyance 106 and a perforating tool assembly 102, i.e., "perforating gun string," "gun string," or "gun assembly," comprising one or more perforating guns. In addition, work string 104 may comprise other downhole tools, such as one or more packers, one or more completion components, e.g., screens and/or production valves, one or more sensing components and/or measuring equipment, i.e., downhole sensors, and other equipment not shown in FIG. 1. In operation, work string 104 is lowered into wellbore 110 and one or more explosive charges disposed within the one or more perforating guns are detonated to perforate casing 112 to facilitate fluid communication between one or more production zones ("pay zones") 118*a*, 118*b*, 118*c*, etc., and wellbore 110.

As will be shown in later figures, e.g., FIGS. 3B and 3E, perforating tool assembly 102 may comprise a single or a plurality of perforating guns, which may be coupled together on a single gun string. While the present figures generally show a single, or a few perforating guns, it should be understood that perforating tool assembly 102 may comprise any suitable number of perforating guns. In one or more examples, the perforating tool assembly 102 may further comprise a firing head for initiating a detonation train to fire each of the perforating guns. In addition, the perforating tool assembly 102 may further comprise tandems, spacers, or other coupling structures for coupling together the perforating guns.

Figure 2:
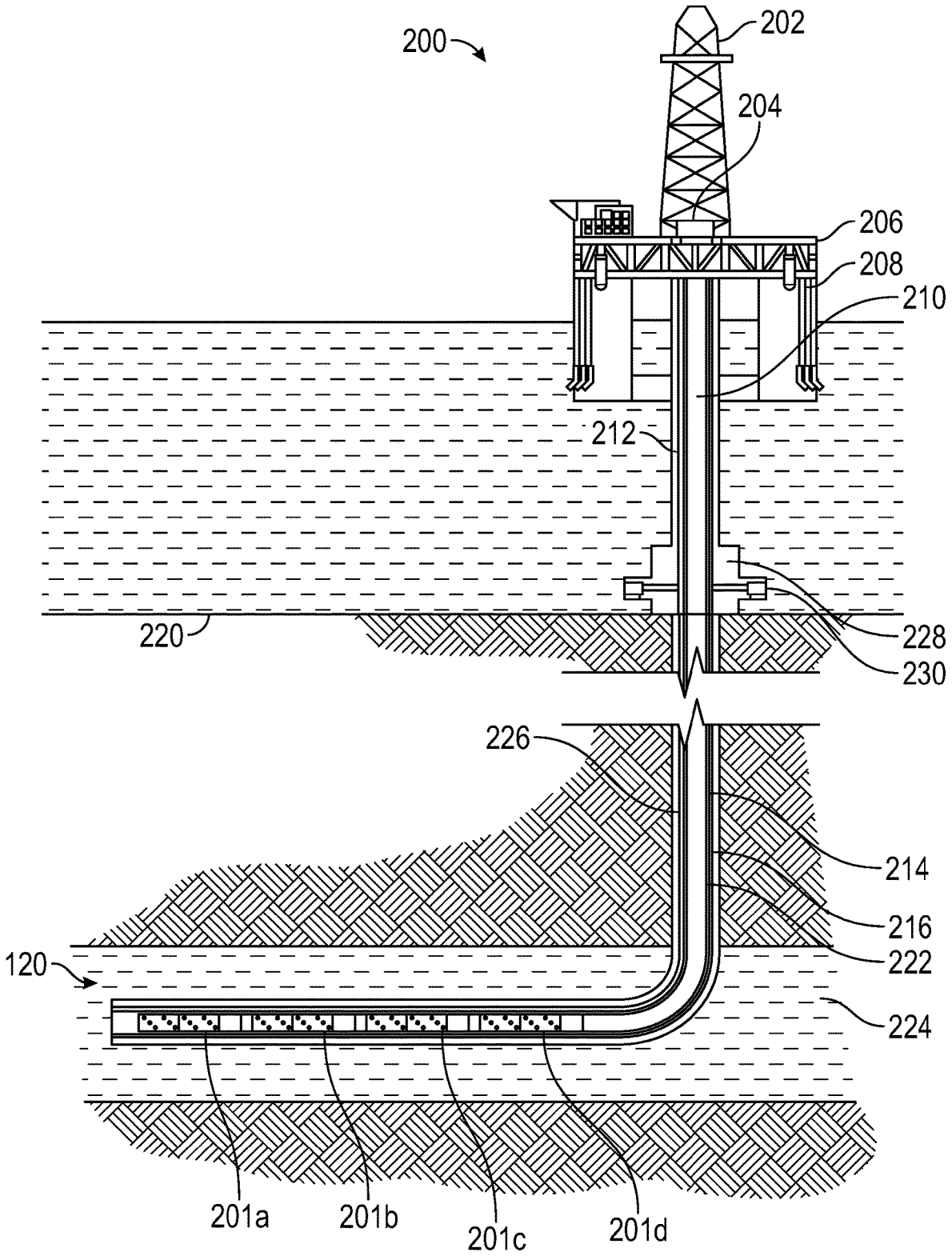
FIG. 2 is a system showing a perforating gun in a wellbore during a sea-based operation, in accordance with some examples of the present disclosure.

FIG. 2 is a system 200 showing one or more perforating guns 201*a*, 201*b*, 201*c*, and 201*d* in a wellbore 214 during a sea-based operation, in accordance with some examples of the present disclosure. As mentioned, the principles shown and described with respect to perforating during land-based operations are equally applicable to sea-based operations.

As illustrated, a wellbore 214 may extend into a subterranean formation 224 beneath a sea floor 220. A semi-submersible platform 206 is centered over a hydrocarbon-bearing formation 224 located beneath a sea floor 220. A subsea conduit 212 extends from deck 208 of platform 206 to wellhead installation 228 which may include one or more subsea blow-out preventers 230. Platform 206 has a hoisting apparatus 204 and a derrick 202 for raising and lowering tubular strings such as work string 210.

Figure 3A:
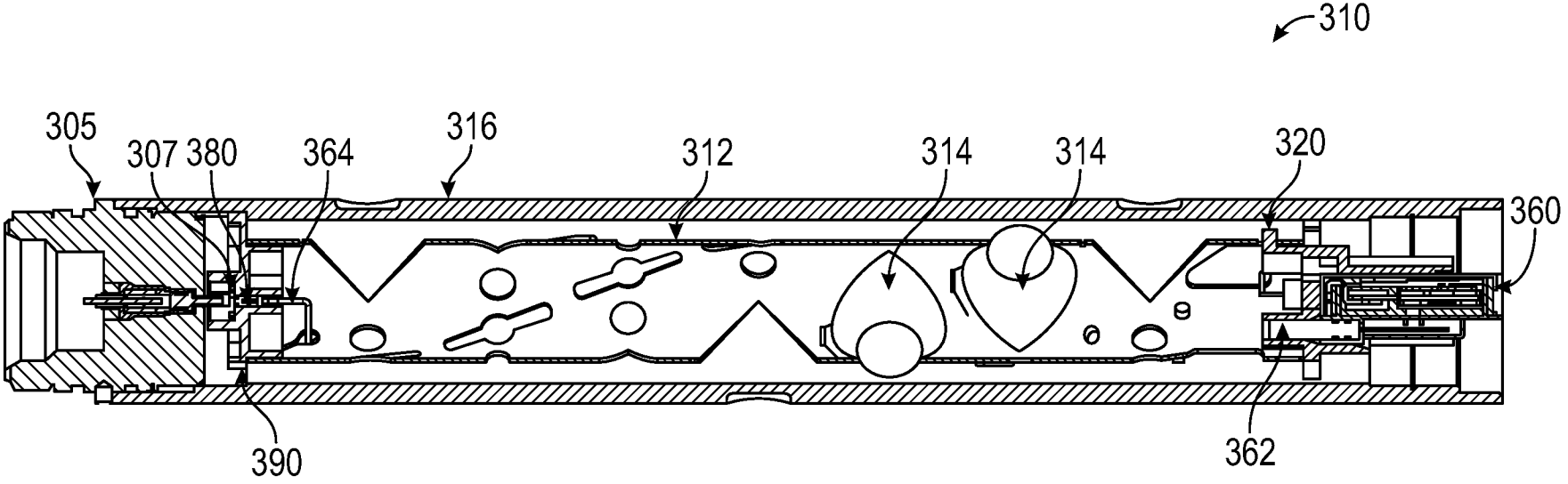
FIG. 3A is a single perforating gun in accordance with some examples of the present disclosure.

A wellbore 214 extends through various earth strata including subterranean formation 224. Casing 226 is cemented within wellbore 214 by cement 216, as with FIG. 1. Work string 210 may be substantially identical to work string 104 (e.g., referring to FIG. 1), except that it is adapted for a subsea environment. In operation, work string 210 is similarly lowered through casing 226 until one or more perforating guns of work string 210 reach a desired depth. Thereafter, the explosive charges are detonated to perforate casing 226. In either of FIG. 1 or 2, detonation may occur in either a down-going (downhole) or an up-going (uphole) fashion. As shown, work string 210 comprises one or more perforating guns 201*a*, 201*b*, 201*c*, 201*d*, etc., which may be joined together during, for example, tubular make-up of the gun string. FIGS. 3A and 3B further show, with more detail, the perforating gun 310.

FIG. 3A is a side view of a single perforating gun 310 in accordance with some examples of the present disclosure. The perforating gun 310 may be one of a plurality of perforating guns connected end-to-end to achieve a perforating gun string (e.g., perforating tool assembly 102 on FIG. 1). The perforating gun 310 includes a gun body 316 that contains a bulkhead 305, an electrical contact 380, a gun body 316, a detonator housing 320 and detonator 360, and an end alignment 390. The gun body 316 is a generally tubular body, in this example, in which the other gun components are disposed. As illustrated, a plurality of perforating charges is secured to the charge tube 312 at different positions and firing orientations along the charge tube 312. The charge tube 312 has a generally continuous tubular construction in this example. However, all other suitable charge tube configurations are also within the scope of this disclosure, such as modular charge tubes formed by snapping together or otherwise interconnecting any number of charge tube segments that each hold one or more perforating charges within a perforating gun.

A detonator housing 320 according to this disclosure is coupled to the charge tube 312 at one end. The detonator housing 320 includes various features facilitating assembly including for securing a detonator, detonating cord, and other components, as further discussed below, and illustrated in subsequent figures. On the opposite end of the charge tube 312 from the detonator housing 320, the bulkhead 305 is secured to the charge tube 312. One purpose of the detonator housing 320 is to safely house the detonator such that it is protected from external influences (e.g., wellbore 110 of FIG. 1, build-up of static charge, etc.).

The end alignment 390 is also coupled to the charge tube 312 at the other end opposite the detonator housing. The end alignment aligns the charge tube 312 within the gun body 316. As will be shown in subsequent figures, one or more (e.g., three, four, five, or more) radial protrusions (e.g., cars 610*a*, 610*b*, 610*c* of FIG. 6A, 6B) may jut out from an inner tubular body of the end alignment 390. These radial protrusions serve to reduce the amount of material of, i.e., skeletonize, the end alignment 390 by not requiring that the whole outer circumference of the end alignment 390 be filled with the material. In addition, the end alignment 390 may comprise one or more alignment features (e.g., mating notch 612 of FIG. 6C) which may also be disposed on one or more of the radial protrusions to facilitate appropriate alignment of the end alignment 390 within the perforating gun 310 when it interfaces with the charge tube 312 and/or bulkhead 305. Specifically, one or more matching slots (not shown) or other corresponding alignment feature (e.g., protrusion(s)) may be machined or designed within the gun body 316 or other component of the perforating gun 310 such that a mating notch 612 slides into place by an assembler when the end alignment 390 is installed within the gun body 316. This/these alignment feature(s) may also serve to circumferentially stabilize the end alignment within the perforating gun 310 so as to prevent differential drift, i.e., rotation, of the end alignment 390 during or after assembly, which may ensure that the wires are not unnecessarily twisted or that the charge tube 312 is not improperly aligned, all the while reducing or preventing the need for additional fasteners. (This is also one function of collet 602, as will be made clear by FIG. 6F-6H). The end alignment 390 also comprises an electrical contact passthrough 307 to house one or more electrical connections.

The bulkhead 305 provides stability and structure to the perforating gun 310 as well as an interface to connect to a neighboring perforating gun. The bulkhead 305 generally comprises a body, an electrical feedthrough to house one or more electrical connections, and a receptacle (e.g., receptacle 560 of FIG. 5G) to hold a contact pin (e.g., contact pin 502 of FIG. 5G).

The gun body 316 is the outer tubular body of the perforating gun 310 which houses all the main components of the perforating gun 310 including the charge tube 312, detonator housing 320, end alignment 390, and at least a portion of the bulkhead 305.

Use in the manner described herein may remove or reduce the need for external fasteners, which further increases productivity at the work site by making it easier for an assembler to assemble the perforating gun 310 and/or tubular gun string. For example, one or more sections of (e.g., the end alignment 390, bulkhead 305, detonator housing 320, charge tube 312, gun body 316, or any tubular components of) the perforating gun 310 may, in some examples, be free or essentially free of external fasteners.

As used herein, a "shipping assembly" comprises an at least partially assembled perforating gun which includes at least a gun body 316, a charge tube 312, and end alignment 390, and a bulkhead 305. A shipping assembly would generally not comprise more than a single bulkhead 305, as coupling of multiple perforating guns (e.g., 310*a*, 310*b* of FIG. 3B) would be achieved on-site during tubular make-up of the gun string (e.g., perforating tool assembly 102 of FIG. 3B). A shipping assembly may also comprise a detonator housing 320, however, installation of the detonator within the detonator housing 320 and perforating charges within the charge tube 312 of the perforating gun 310 would be generally performed on site to eliminate the risk of premature activation and accidental detonation of the perforating gun 310 prior to a perforating operation. However, in one or more examples, a shipping assembly may be loaded with detonating charges, or unloaded, as mentioned.

Figure 3B:
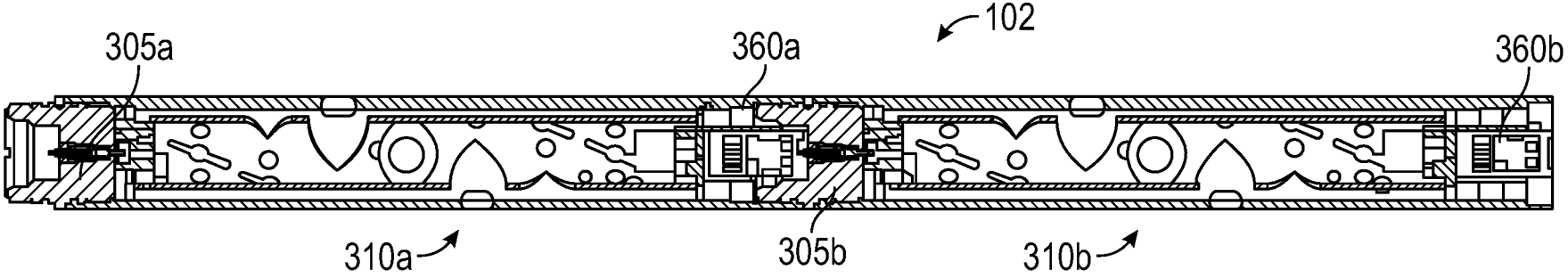
FIG. 3B shows a tubular string with two perforating guns coupled together, in accordance with some examples of the present disclosure.

FIG. 3B shows a perforating tool assembly 102 with two perforating guns 310*a* and 310*b* coupled together, in accordance with some examples of the present disclosure. A first perforating gun 310*a* may be coupled to a second perforating gun 310*b* end-to-end, as illustrated. In the illustrated example, the first perforating gun 310*a* is uphole from the second perforating gun 310*b*.

In one or more examples, a detonation signal is transmitted during operation along the perforating tool assembly 102 in a down-going fashion. For example, the detonation signal may proceed from gun to gun, arriving first at the detonator 360*a* before passing through an electrical feedthrough (e.g., electrical feedthrough 306 of FIG. 3B) of the bulkhead 305*b* of the second (downhole) perforating gun 310*b*. Detonation may occur in a generally down-going fashion following the detonation signal, with the detonation of the second perforating gun 310*b* following detonation of the first perforating gun 310*a*. However, in examples, detonating of the various perforating charges of each individual perforating gun 310*a*, 310*b*, etc., may occur in an up-going direction. This may ensure that the detonation signal always proceeds to the next (downhole) perforating gun in a perforating tool assembly 102. For example, this exemplary configuration prevents scenarios in which a detonation signal is outpaced by the actual detonation of the detonation train, which could potentially result in only a partial detonation of the perforating tool assembly 102. Thus, the risk of detonation failure may be reduced by positioning detonator 360*a* of the first perforating gun 310*a* at the lower end of the gun, e.g., at least partially disposed within the bulkhead 305*b* of the second perforating gun 310*b*, as illustrated.

As mentioned, at least a portion of detonator housing 320*a* corresponding to the first perforating gun 310*a* may be disposed within a bulkhead 305*b* corresponding to the second perforating gun 310*b*. Coupling of a first perforating gun 310*a* to a second perforating gun 310*b* in this manner allows for reliable transmission of a detonation signal (e.g., from an initial firing signal) to propagate along one or more signal conductors (e.g., wires 346*a*, 346*b* in FIG. 3C) traversing the length of the perforating tool assembly 102, thus allowing serial detonation of each perforating gun of the perforating tool assembly 102.

Figure 3C:
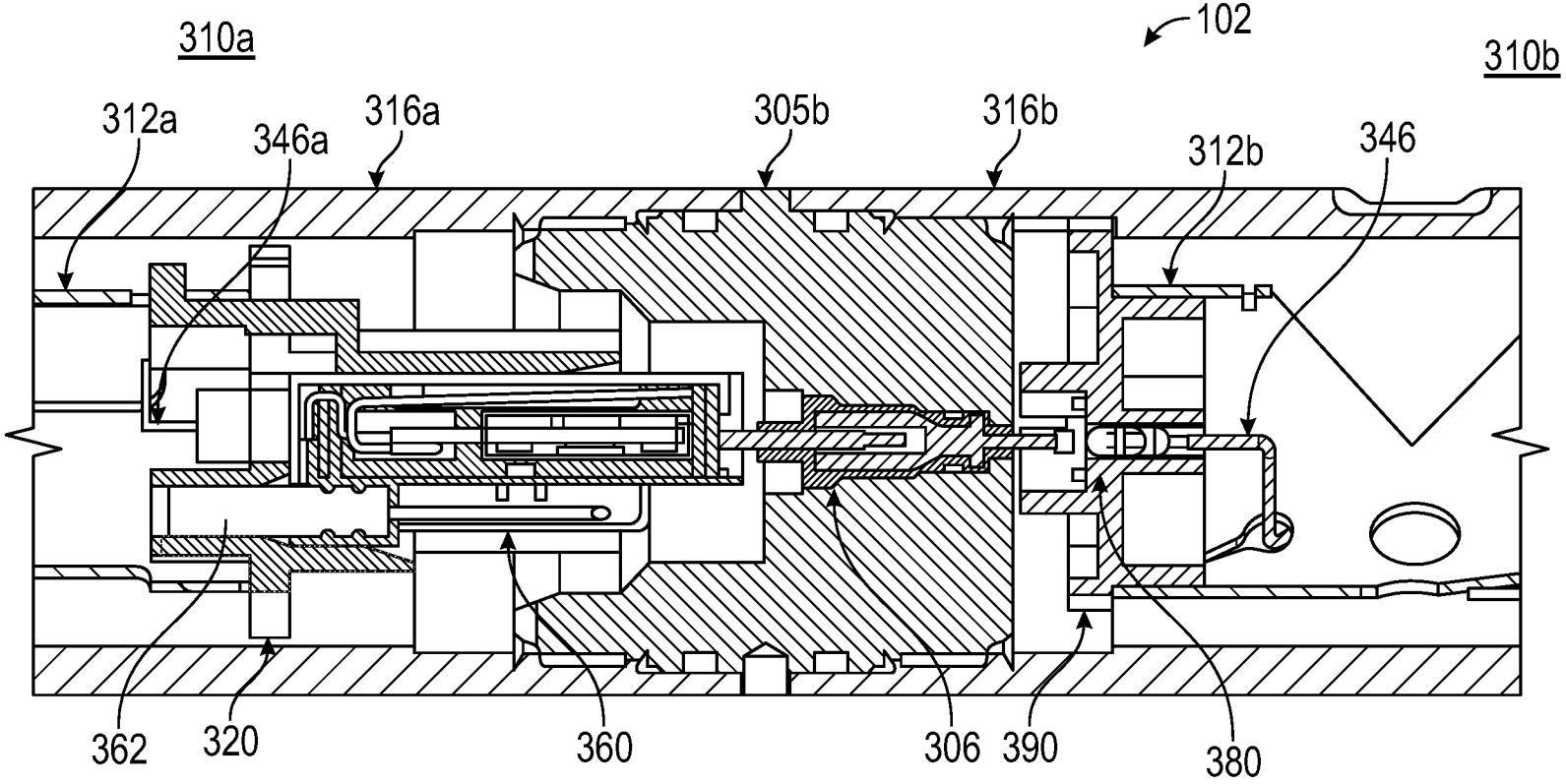
FIG. 3C is an enlarged section showing the connection between two perforating guns of FIG. 3B, in accordance with some examples of the present disclosure.

FIG. 3C is a close-up view of the section of FIG. 3B where the two perforating guns 310*a* and 310*b* are coupled together. As shown, the first gun body 316*a* is coupled to the second gun body 316*b* by a bulkhead 305*a* and an end alignment 390 of the second gun 310*b*. Also visible is the detonator housing 320 of the first perforating gun 310*a* housing a detonator 360, and an electrical contact 380 which electrically couples the two guns through an electrical feedthrough 306 of the bulkhead 305*a*, to be discussed later in detail. In operation, an electrical signal traveling through wire 346*a* of the first perforating gun 310*a* passes to the detonator 360 and explosive initiator 362 seated within the detonator housing 320 and ignites a detonating cord (e.g., detonating cord 740 in FIG. 7A) to trigger detonation of the first perforating gun 310*b*. As alluded to previously, the detonation signal then passes through an electrical feedthrough 306 of the bulkhead 305*b* of the second perforating gun 310*b* from where it enters an electrical contact 380, passes through an electrical feedthrough of an end alignment 390, and enters the next perforating gun 310*b* of the perforating tool assembly 102.

As mentioned previously, build-up of static charge within the detonator housing 320 may pose a risk to detonation by interfering with the detonation signal. To that end, a grounding clip is provided in FIG. 4A which may address at least in part this issue.

Figure 4A:
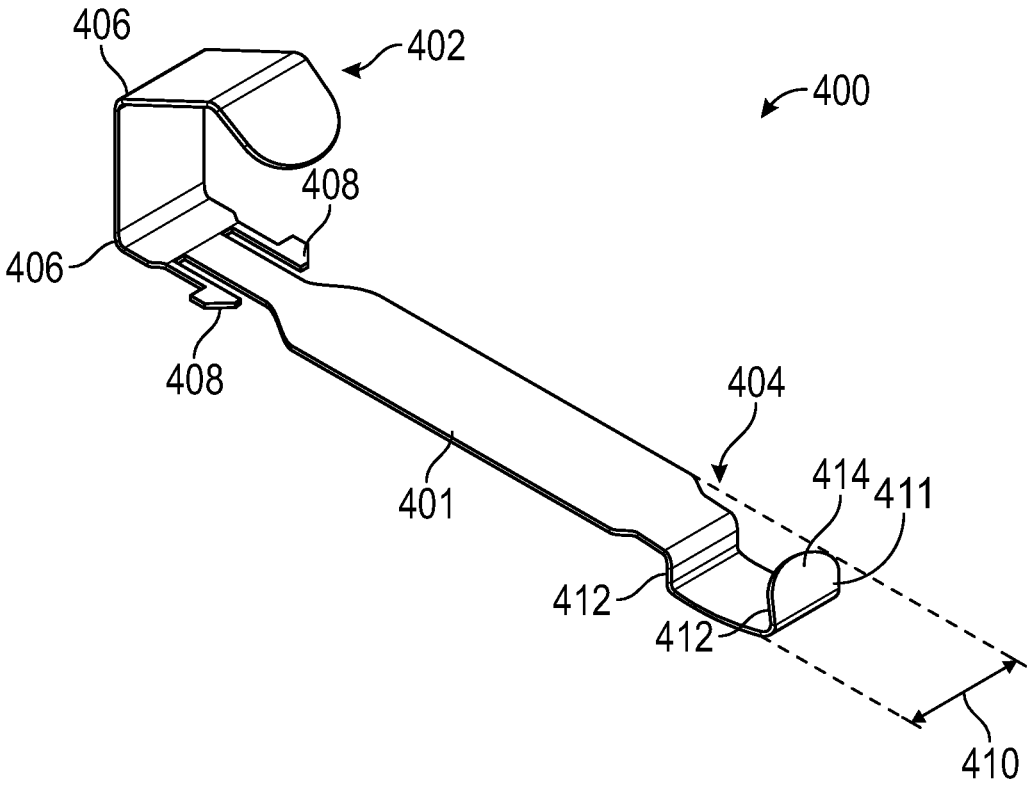
FIG. 4A is a grounding clip, in accordance with some examples of the present disclosure.

FIG. 4A shows a grounding clip 400, in accordance with examples of the present disclosure. As will be discussed in more detail below, the grounding clip 400 is secured to the detonator housing 320 (e.g., shown on FIG. 4B) to provide a ground to the gun body 316 (e.g., shown on FIG. 3A). The grounding clip 400 may comprise a single piece of conductive metal having an elongated body portion 401 with two consecutive inward bends 406 on the upper end 402 that lead to a ninety-degree bend towards the axial direction of the perforating gun 310 (e.g., shown on FIG. 3). Two wing features, or flexible locking tabs 408, from the elongated body portion 401 can be compressed towards the central axis of the grounding clip 400, which allow it to be seated within a slot (e.g., slot 418 on FIG. 4C), and deflect outwards resulting in a fixed retention method once installed. The feature of flexible locking tabs 408 allows for the apparatus to be axially locked into place once inserted into a mating slot of the detonator housing 320, to be discussed in later figures. In some examples, the flexible locking tabs 408 may also prevent personnel from accessing the connection between the detonator housing 320 and the charge tube 312 (e.g., shown on FIG. 3A) after assembly.

The grounding clip 400 has a width 410. On the lower end 404 of the grounding clip 400 opposite from the upper end 402, the grounding clip 400 has a reduced diameter portion 411 where the width 410 is reduced so that short bends 412 leading to a tapered bend 414 are angled in such a way for a mating contact point for grounding additional components. Specifically, the tapered bend 414 may provide an interference contact point so that the detonator housing 320 is grounded to a machined metal surface of the bulkhead 305*b* (e.g., referring to FIG. 3C). The inward bends 406 may also act as an upper contact point so that the upper end 402 makes an interference contact with a machined metal surface of the gun body 316 (e.g., referring to FIGS. 3A, 3C, 4A) when installed in a perforating gun 310 (e.g., referring to FIG. 4F).

Figure 4B:
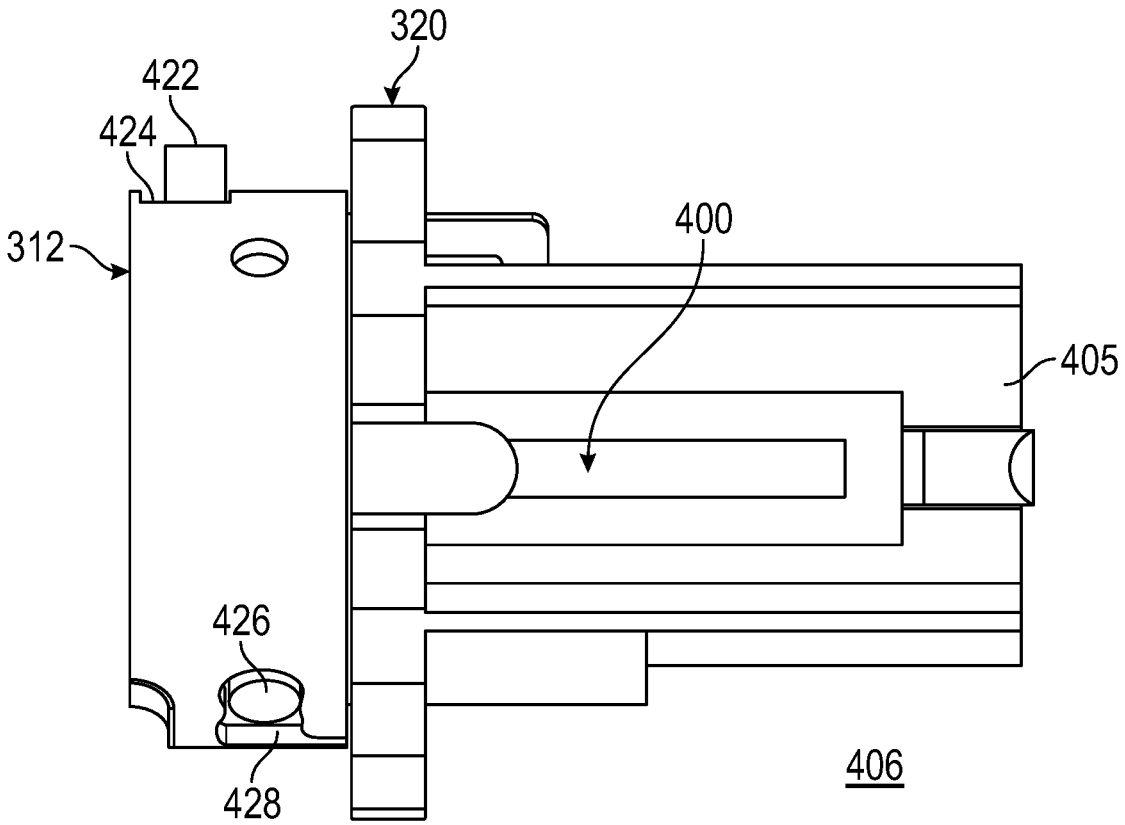
FIG. 4B is a top view of a charge tube and a detonator housing and which shows the grounding clip, in accordance with some examples of the present disclosure.

FIG. 4B is a top view of the charge tube 312 and detonator housing 320. As illustrated, the grounding clip 400 is secured in the detonator housing 320. Visible are both the upper end 402 and the lower end 404 of the grounding clip 400. As illustrated, the upper end 402 may wrap around a radial protrusion 321 of the detonator housing 320 while the lower end 404 ends beyond an axial end 405 of the detonator housing 320. As illustrated, when the perforating gun 310 is assembled, the upper end 402 may be seated against both the detonator housing 320 and the charge tube 312 such that it physically contacts both. In some examples, this design provides increased reliability for perforating gun systems by virtue of multiple grounding points.

Also visible in FIG. 4B is the collet 422 and lug 426 of the detonator housing 320 seated within openings 424 and 428 of the charge tube 312. As mentioned, these interlocking features may facilitate assembly and reduce or remove the need for external fasteners.

Figure 4C:
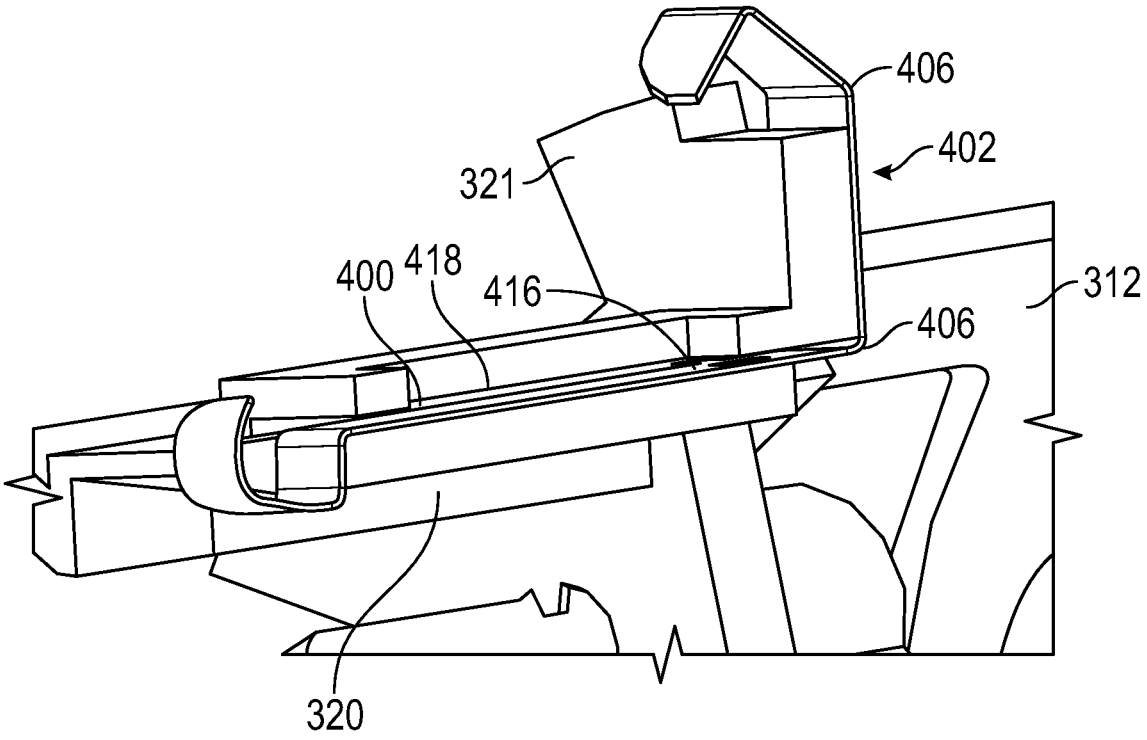
FIG. 4C is a perspective cross-sectional view of the detonator housing showing the grounding clip locked into place by a shoulder in a slot of the detonator housing, in accordance with some examples of the present disclosure.

FIG. 4C shows an angled cross sectional view of the detonator housing 320 and grounding clip 400. As illustrated, the flexible locking tabs 408 are locked into place by a shoulder 416, and the upper end 402 wraps around a radial protrusion 321 of the detonator housing 320. Also visible is the slot 418 within which the grounding clip 400 is inserted during assembly. During operation, the grounding clip 400 is held within the detonator housing 320 by the slot 418. As illustrated, the inward bends 406 of the grounding clip 400 may be oriented such that part of the upper end 402 is biased at an angle (e.g., 45 degrees) away from the detonator housing 320. This biasing of the upper end 402 away from the detonator housing 320 ensures that the upper end 402 maintains axial contact with the gun body 316 (e.g., referring to FIG. 3A). Specifically, the inward bends 406 may resist compression when the charge tube 312 and detonator housing 320 are housed by the gun body 316 (e.g., referring to FIG. 3A).

This axial contact with the gun body 316 ensures that multiple grounding pathways are provided through the apparatus by means of contact points between the elongated body portion 401 and the slot 418, between the upper end 402 and the gun body 316 (e.g., referring to FIG. 3A), and optionally, between the charge tube 312 and the grounding clip 400. These contact points may electrically couple the various conductive surfaces of the perforating gun 310 (e.g., referring to FIG. 3A) together, thereby providing an electrical pathway for static electricity away from the detonator housing 320.

Figure 4D:
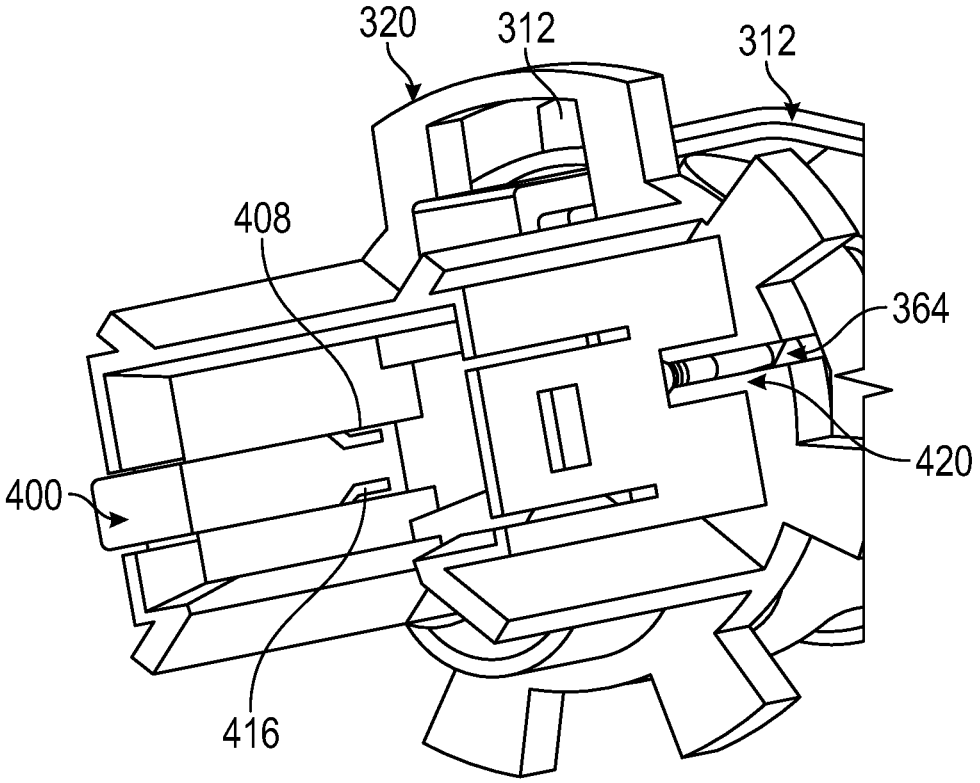
FIG. 4D is a perspective view of the detonator housing and charge tube from within detonator housing, with the detonator omitted for reference, to show the flexible locking tabs of the grounding clip in accordance with some examples of the present disclosure.

FIG. 4D is a view inside detonator housing 320, with the detonator omitted for reference. Visible are the flexible locking tabs 408 and shoulder 416, as well as the lower end 404 of the grounding clip 400. Also shown is the wire 346 which is electrically coupled to a pin 420 that seats in the detonator housing. In operation, the pin 420 passes the detonation signal from the wire 346 to the detonator 360 (e.g., referring to FIG. 4A). Use in this manner provides a good, reliable connection with the detonator 360. Also visible is a collet (e.g., collet 422 of FIGS. 4B, 4D, 8A) of the detonator housing 320 which interlocks the detonator housing 320 to the charge tube, to be discussed in more detail in later figures.

Figure 4E:
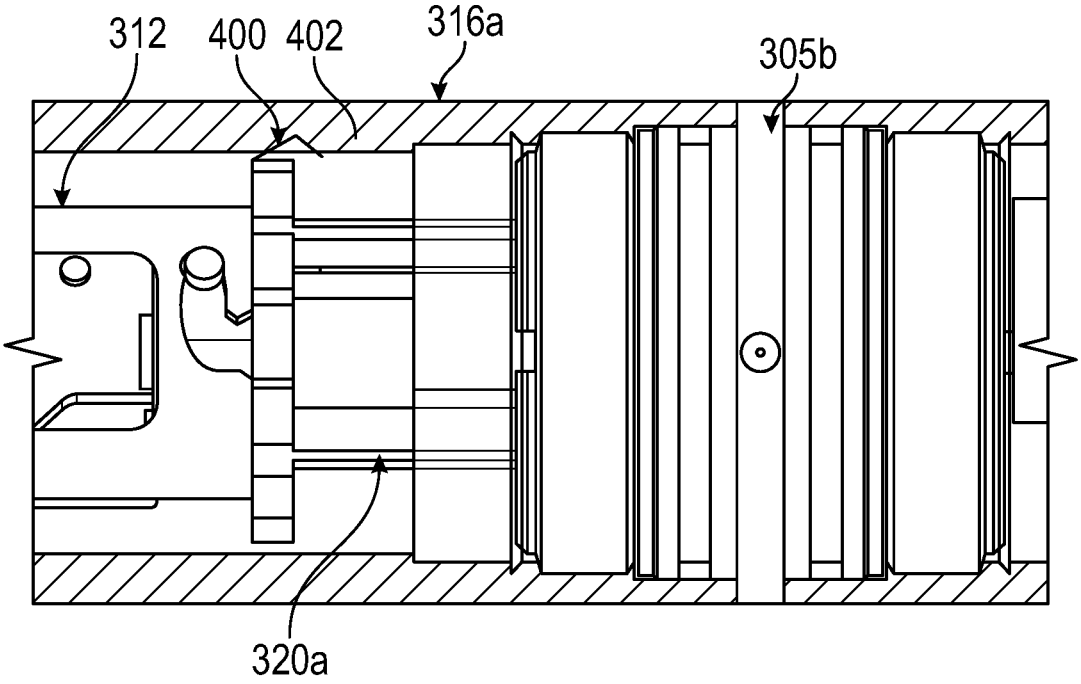
FIG. 4E is a side view of a portion of the perforating gun containing the detonator housing and bulkhead, with a portion of the gun body omitted for reference to show the grounding clip, in accordance with some examples of the present disclosure.

FIG. 4E is a semi-transparent view of the perforating tool assembly 102 (e.g., referring to FIG. 3B) that shows the charge tube 312 coupled together with the detonator housing 320*a* of the first perforating gun 310*a* (e.g., referring to FIG. 3B, 4A), which may be coupled to the bulkhead 305*b* of the second perforating gun 310*b*. In this figure, the upper end 402 of the grounding clip 400 is shown in a compressed state (e.g., 45 degrees or less relative to the central axis of the detonator housing 320). In some examples, the upper end 402 of the grounding clip 400 may be compressed such that it is less than 30 degrees relative to the central axis, and in some examples, flat against (parallel to) the gun body 316*a*.

Figure 4F:
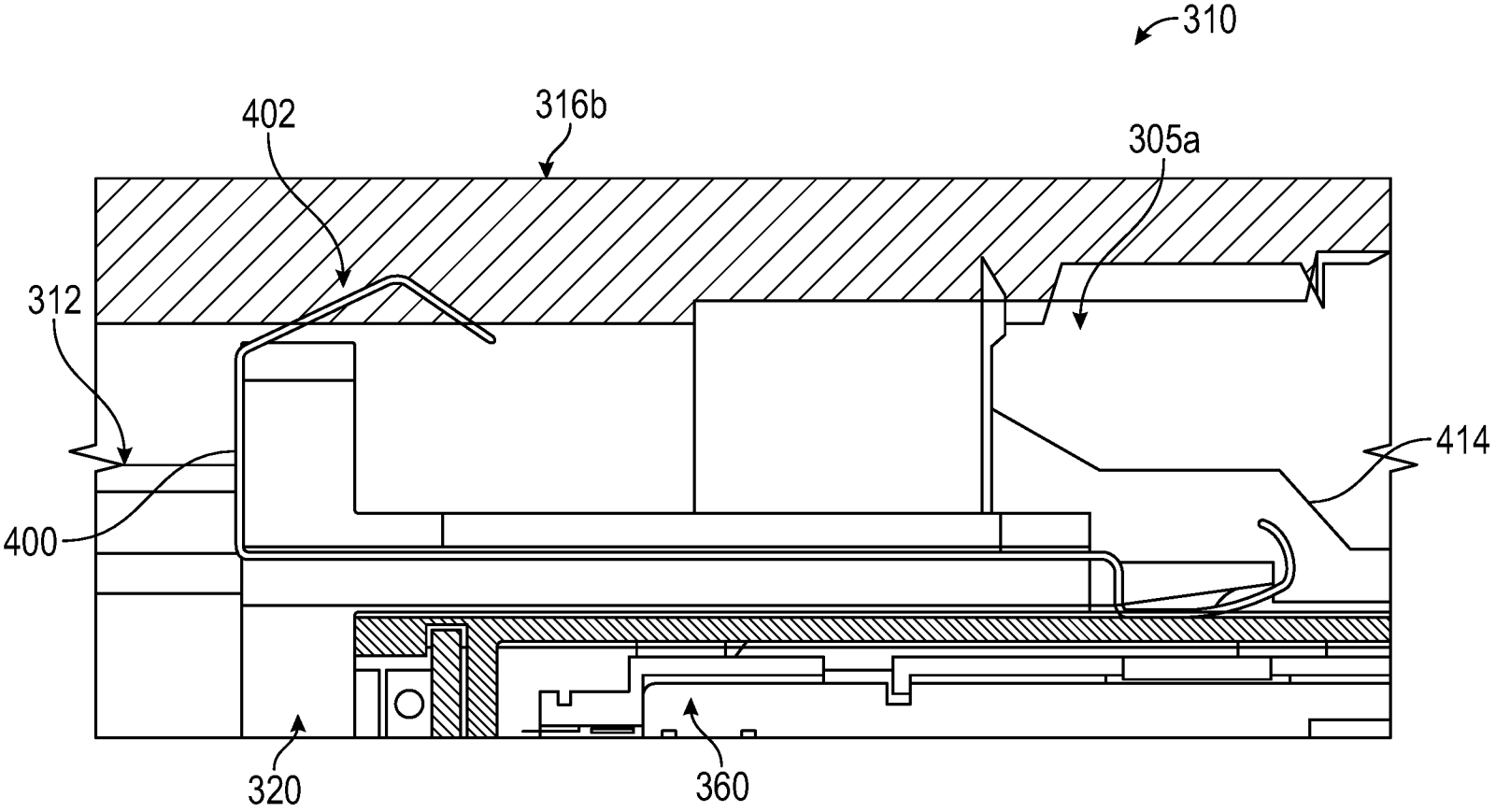
FIG. 4F is an enlarged, cross-sectional side view of the grounding clip disposed within the perforating gun and extending into a bulkhead of a second perforating gun, in accordance with some examples of the present disclosure.

FIG. 4F is a cross-sectional side view of the charge tube 312, detonator housing 320, and bulkhead 305. FIG. 4F shows the grounding clip 400. As mentioned, the upper end 402 of the grounding clip 400 may be compressed (not shown) by the gun body 316*b* such that it conforms to the longitudinal surface of the gun body 316*b* and exerts a spring-like force on the gun body 316*b*, ensuring good grounding between the two components. Tapered bend 414 may likewise be compressed upon connection of two neighboring perforating guns 310*a*, 310*b* (e.g., referring to FIG. 3B) such that a spring-like force is exerted on one or more regions of the bulkhead 305*a* (e.g., chamfered surface of an inner diameter thereof), as well as on the detonator housing 320 and/or detonator 360. Again, this ensures that the components of the perforating gun 310 are sufficiently grounded, thereby preventing or mitigating the likelihood of detonation failure upon firing of the detonation signal.

Figure 5A:
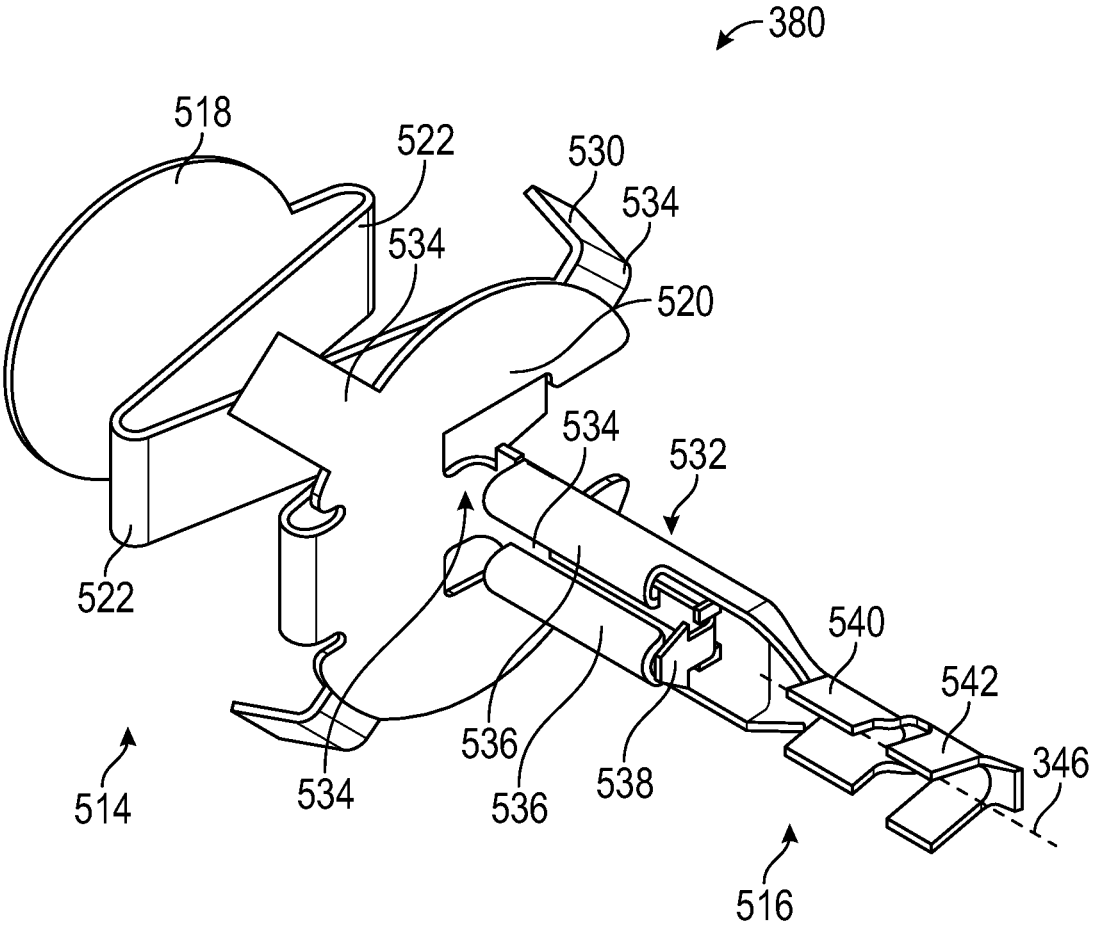
FIG. 5A is an isometric view of the electrical contact, in accordance with some examples of the present disclosure.

FIG. 5A is an isometric view of the electrical contact 380. As mentioned, the electrical contact 380 provides improved, more reliable electrical connection between perforating guns, such as between the first perforating gun 310*a* and the second perforating gun 310*b* (e.g., referring to FIG. 3B). The electrical contact 380 of the present disclosure specifically allows for improvements related to the prevention of electrical contact failures, e.g., open circuit failures, between the electrical contact and the contact pin 502. Technical improvements include, without limitation, improved spring force needed to counteract the deformation caused by the contact pin 502. The addition of multiple (e.g., three, four, five, six, or more) bends 522 after the contact plate 518 keeps the contact plate 518 axially located during deformation from contact with the contact pin 502. The addition of fins 530 and a support plate 520 allow for centralization of the electrical connector 514 after assembly, as well as add retention by means of interference with housing, creating a stable anchor point for the electrical assembly.

As illustrated, the electrical contact 380 generally comprises an electrical connector 514 and a wire connector 516. The electrical connector 514 and wire connector 516 may comprise two separate pieces or may unitarily form a single piece. For ease of manufacturing, however, it may be desirable for the electrical contact 380 to comprise two separate pieces, which are joined together at a mated connection 532. Alternatively, the two separate pieces may be welded, soldered, crimped, or joined in any suitable manner such that electrical connector 514 and wire connector 516 have a reliable electrical connection.

An example configuration of the electrical connector 514 is that it comprises a contact plate 518 on the upper end, i.e., uphole end, followed by multiple bends 522 leading to another support plate 520 on the lower end with fins 530 that provide stability to that part as well as retention when installed after a wire connector 516 of the electrical contact 380 that accepts the mating end 534. The support plate 520 may also have multiple bends 522 which may aid in the ability to maintain axial contact with the end of the contact pin 502 (e.g., referring to FIG. 5A) while providing sufficient spring force to counteract deformation caused by the pin. The support plate 520 also may comprise fins 530 which may further provide centralization, retention, and stability as an anchor point. Specifically, an inner diameter of the end alignment 390 (e.g., referring to FIG. 5F, 5G) where the electrical connector 514 may be undersized in a way such that the fins 530 bite into the inner diameter so as to provide stability. Also, once assembled, the fins 530 may allow contact between electrical connector 514 and the inner diameter of the end alignment 390 such that the electrical connector 514 experiences a resistive force, thereby centralizing it. A mating end 534 may axially extend from the support plate 520.

An example configuration of the mated connection 532 (e.g., wire connector) is that it comprises one or more mating slots 536 and a stop 538. In this way, the mating end 534 of the electrical connector 514 may be inserted into the one or more mating slots 536 until it reaches the stop 538. In some examples, the mated connection 532 between wire connector 516 and the electrical connector 514 may comprise or be accompanied by one or more crimped connections, such as by crimping the one or more mating slots 536 on the mating end 534 of the electrical connector 514. Use in this manner may ensure a good, reliable connection between a wire 346 and the electrical contact 380, and therefore by extension, between a first perforating gun 310*a* and a second perforating gun 310*b* of a gun string (e.g., referring to FIG. 3B).

One or more crimped connections may additionally be used to electrically couple wire 346 to the wire connector 516. As illustrated, the wire connector may, in some examples, comprise two wire crimping sections 540, 542. As illustrated, the two wire crimping sections 540 and 542 may be vertically displaced from each other relative to a longitudinal axis of the mating end 534 of the electrical connector 514. Use in this manner may, in some examples, allow for more secure fastening of the wire 346 to the wire connector 516.

Figure 5B:
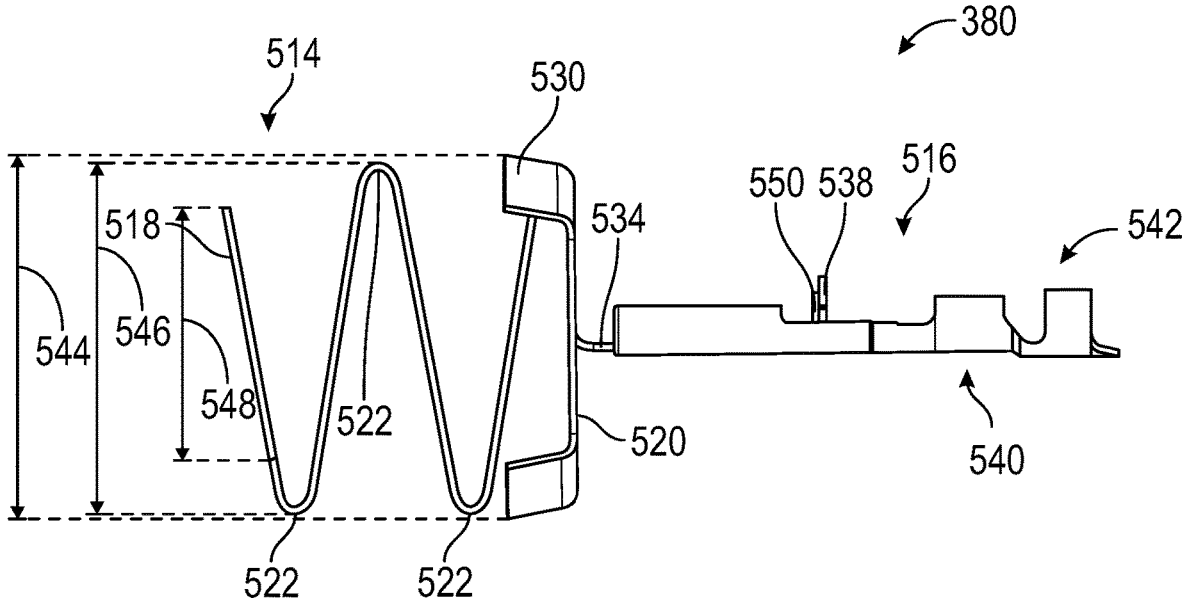
FIG. 5B is a side view of the electrical contact, in accordance with some examples of the present disclosure.

FIG. 5B is a side view of the electrical contact 380. As illustrated, the 2D bend-to-bend distance 546 of the electrical contact 380 may be approximately equal to or less than the diameter of the periphery 544 formed by the fins 530, but greater than the 2D distance 548 of the contact plate 518. As used herein, "approximately equal to" in this context refers to a margin of +/−5%. This ensures that the fins 530 properly limit side-to-side mobility of the electrical contact 380, i.e., relative to the central axis of the electrical contact 380, when disposed within the end alignment 390 (e.g., referring to FIG. 5F, 5G). The number of bends 522 may vary, however, may be three or more, such as four in the illustrated example. Alternatively, five, six, seven, etc. A high number of bends ensures that prolonged contact with the contact pin 502 limits the amount of permanent (inelastic) deformation undergone by the electrical contact 380. While a small, expected amount of inelastic deformation is inevitable as the natural result of engaging the contact pin 502 for any amount of time, the disclosed designs having the high number of bends increases the amount of stress and/or strain that would be required to disrupt the electrical contact's 380 ability to properly and reliable engage the contact pin 502. In other words, designing the electrical contact 380 with more bends 522 increases its longevity and reliability despite prolonged compression by the contact pin 502, such as that applied during transport, assembly, or any prolonged amount of time that the contact pin 502 is engaged prior to detonation.

As illustrated, the protrusion 550 of the mating end 534 of the electrical connector 514 may seat against the stop 538 of the wire connector 516. This particular arrangement may, in some examples, ensure that the mating end 523 is inserted at the correct insertion distance in the mating slots 536 (e.g., referring to FIG. 5A) of the wire connector 516. Also visible in this figure is how vertically-displaced crimping section 542 of the wire connector 516 may be situated below the in-line crimping section 540, for example, by at least 1 millimeter, at least 4 millimeters, or at least 10 millimeters below the in-line crimping section 540. As mentioned, this may allow in some examples more secure fastening of the wire 346 to the wire connector 516 as well as reduced likelihood of frictional wear or undue stress experienced by the wire 346.

Figure 5C:
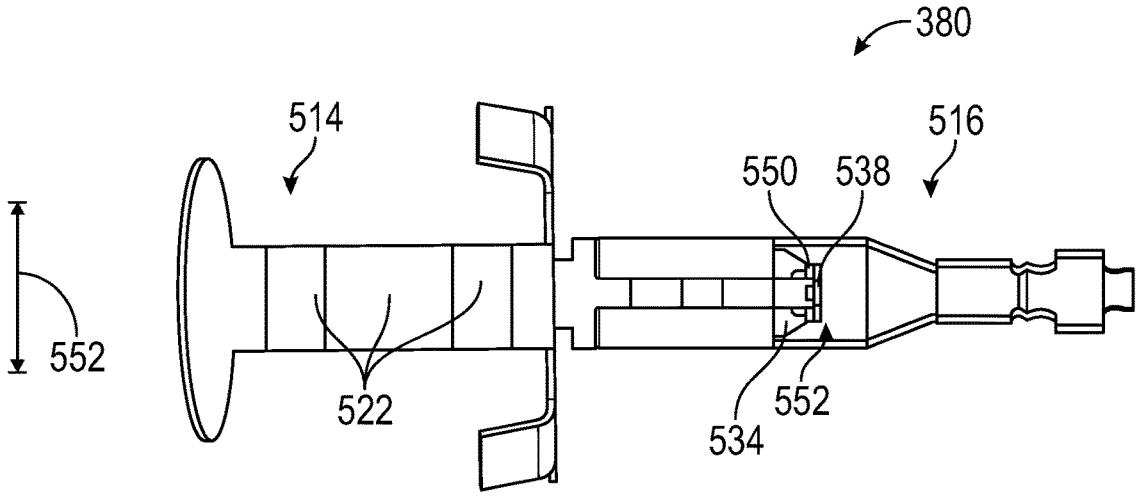
FIG. 5C is a side view of the electrical contact, in accordance with some examples of the present disclosure.

FIG. 5C is a side view of the electrical contact 380 of FIG. 5B rotated by 90 degrees, in accordance with one or more examples of the present disclosure. As illustrated, the portion of the electrical connector 514 with the bends 522 may be substantially similar in width 552 to the body of the wire connector 516. Alternatively, the width 552 may be narrower or wider than the wire connector 516. The magnitude of the width 552 may vary inversely with the required number of bends 522 needed to provide a reliable electrical connection. For example, a larger width 552 may require a smaller number of bends 522 while a narrower width 552 may require more. Also visible in this figure is the protrusion 550 of the mating end 534 of the electrical connector 514 seated against the stop 538, as seen in FIG. 5B, as well as one exemplary configuration of a lock receptacle (i.e., "quick connect") of the wire connector 516 with which the mating end of the electrical connector 514 may be engaged.

Figure 5D:
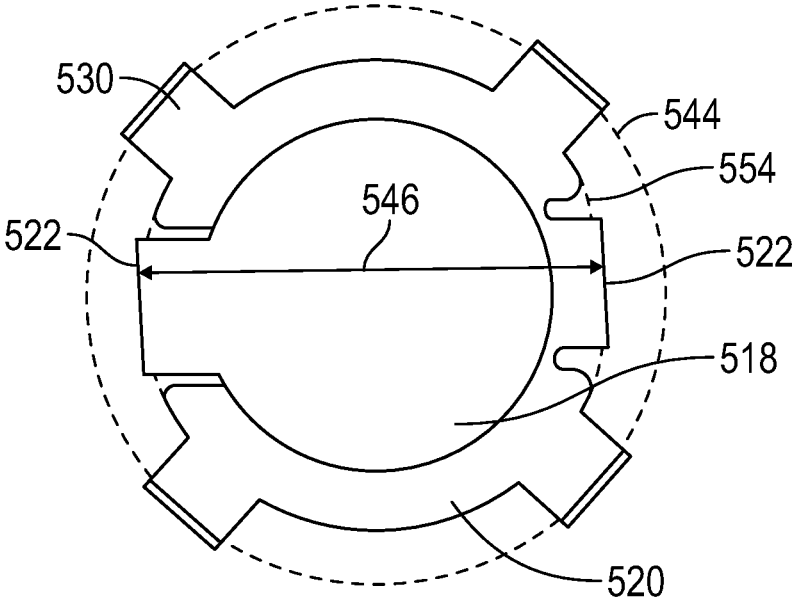
FIG. 5D is downhole view of the electrical contact, in accordance with some examples of the present disclosure.

FIG. 5D is a downhole view of the electrical contact 380 in accordance with one or more embodiments. As illustrated, the 2D distance 546 spanned by the bends 522 may, in some examples, exceed the diameter 544 of the support plate 520 without the fins 530. Alternatively, the 2D distance 546 may be less than the diameter of the periphery 544, as previously mentioned. Also visible is how the contact plate 518 may have a smaller circumference than the diameter 554 of the support plate 520, however, the contact plate 518 may have a circumference up to or surpassing the outer diameter of the support plate 520. Also visible in this figure is the 2D linear distance 448 formed by the contact plate 518, which may be less than the two dimensional linear distance 446 of the bends 522.

Figure 5E:
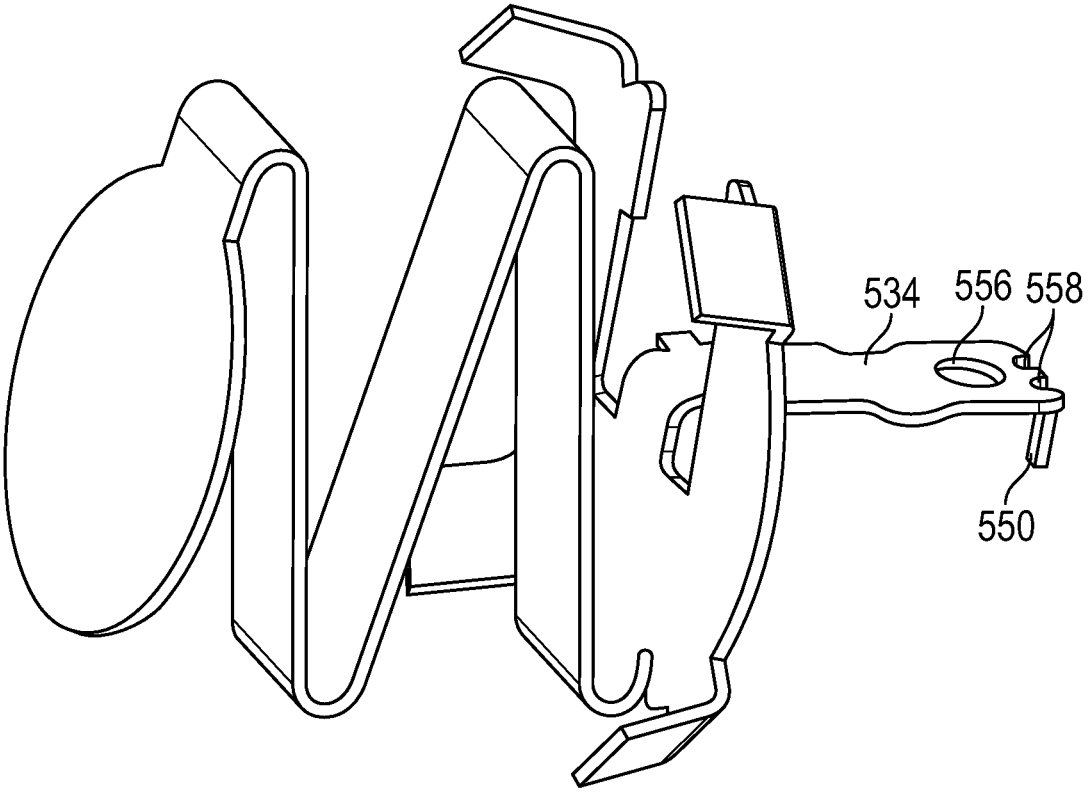
FIG. 5E is a schematic illustration of the electrical contact with the wire connector omitted for reference, in accordance with some examples of the present disclosure.

FIG. 5E is a perspective side view of electrical contact 380 with the wire connector 516 omitted for reference to show the mating end 534, in accordance with one or more embodiments. The electrical connector 514 in this figure is flipped upside-down with reference to FIG. 5C to show the mating end 534 of the mated connection 532 (e.g., referring to FIG. 5A). Also visible is a hole 556, as well as the protrusion 550 and one or more divots 558 of the mating end 534. The hole 556 may correspond to a small tab which may serve as a retention feature. Divots 558 may be used with a positive lock receptacle of the wire connector 516.

Figure 5F:
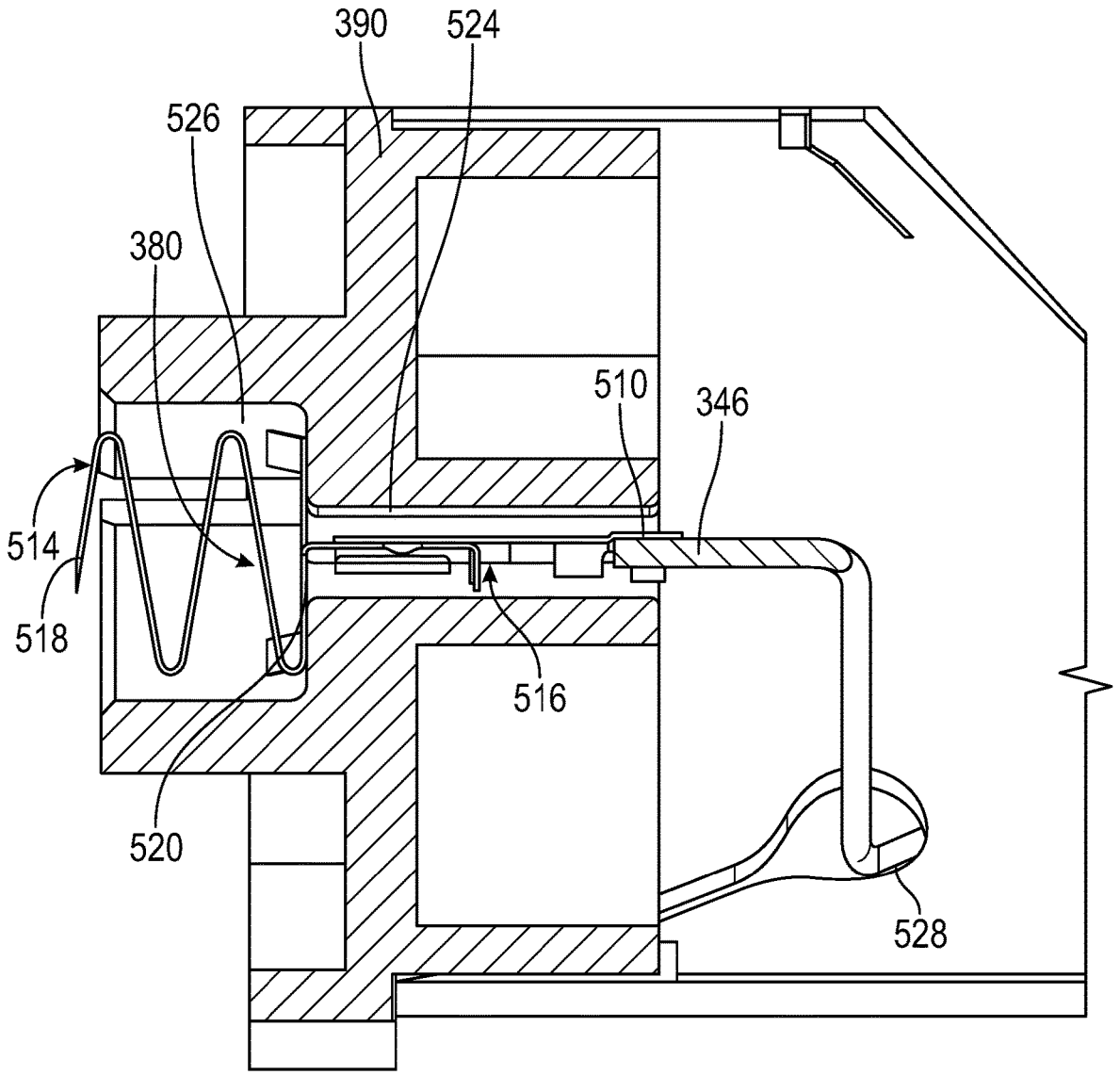
FIG. 5F is a cross-sectional, enlarged side view of the perforating gun at the end alignment, with the contact pin omitted for reference to show the electrical contact in an uncompressed state.

FIG. 5F is a close-up view of the interface between the end alignment 390 and the charge tube 312, which shows the electrical contact 380 in an uncompressed state. As shown, wire 346 may be electrically coupled to electrical contact 380 via, for example, one or more crimped connections 510. Alternatively, by any suitable wire connection. The crimped portion of the wire may or may not be insulated, so long as the wire 346 has sufficient contact area with a conductive portion of the electrical contact 380 so as to successfully transmit an electrical signal to the contact plate 518 when it is compressed against the contact pin 502 (e.g., referring to FIG. 5A). As illustrated, at least a portion of the wire connector 516 and/or electrical connector 514, or more generally, electrical contact 380, passes through one or more internal regions of the end alignment 390, such as through a passageway of first region 524 and a passageway of second region 526 characterized by a first (smaller) and second (larger) inner diameter respectively, as illustrated. Use in this manner may serve to both minimize the amount of space occupied by the electrical contact 380 as well as ensure that the electrical contact 380 is oriented properly with respect to the contact pin 502 and within the one or more internal regions of the end alignment 390. Also visible are the fins 530 of the support plate 520 which serve to centralize the electrical contact 380 within the passageway of the second region 526 of the end alignment 390 and prevent improper alignment of the electrical contact 380 relative to the contact pin 502. Specifically, the fins 530 may prevent differential and/or vertical (i.e., relative to a central axis of the passageway through the first region 524 of the end alignment 390) drift of the electrical contact 380 during and/or after tubular make-up of the gun string, to be discussed in more detail in later figures. Also visible is an opening 528 through which the wire 346 may pass through in some examples to provide electrical communication between signal conductors of neighboring perforating guns (e.g., wire 346*a* and wire 346*b* of FIG. 3C), via the electrical contact 380.

Figure 5G:
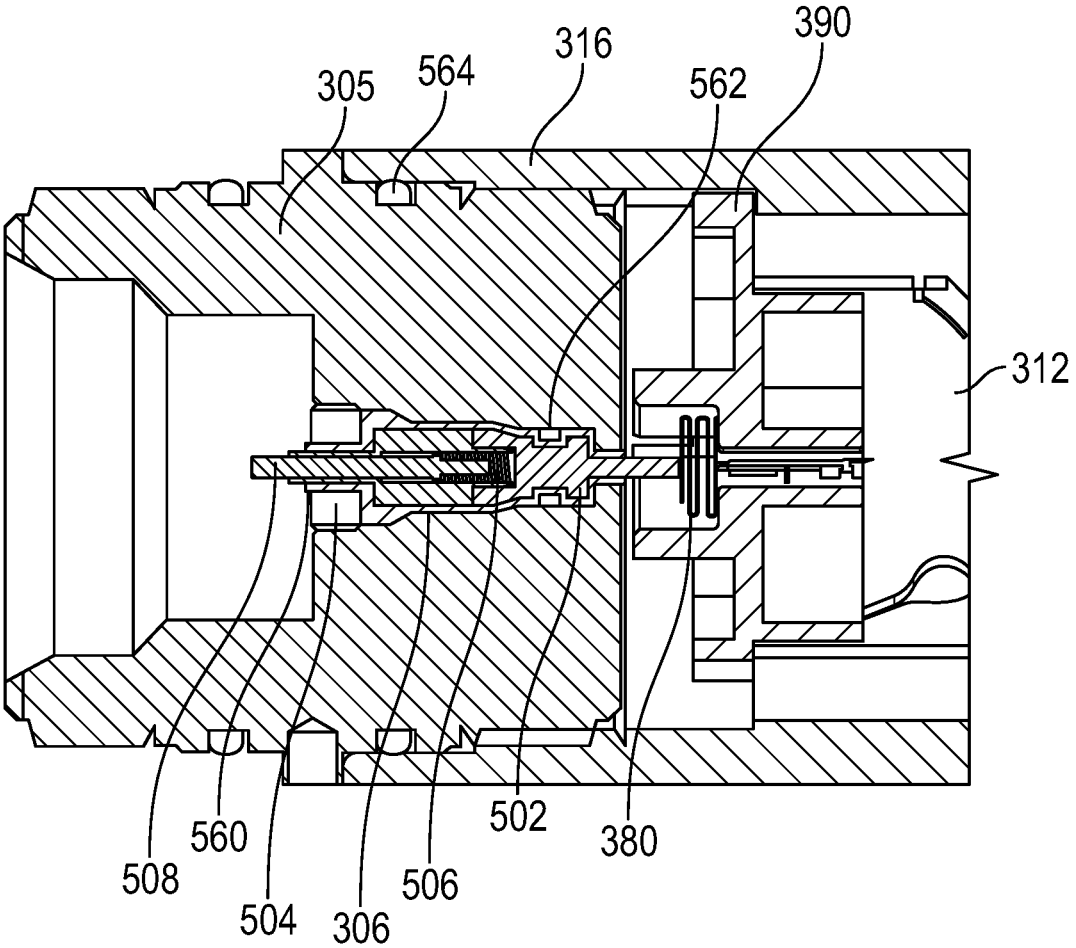
FIG. 5G is a cross-sectional, enlarged side view of the perforating gun at the bulkhead, which shows the electrical contact in a compressed state against a contact pin, in accordance with some examples of the present disclosure.

FIG. 5G is a close-up view of the interface between the bulkhead 305 and the end alignment 390. As illustrated, the electrical contact 380 is disposed in a through passageway of the end alignment 390. In the illustrated embodiment, the electrical contact 380 is in a compressed state while contacting the contact pin 502 that extends from the electrical feedthrough 306 of the bulkhead 305. In operation, an electric signal is passed (e.g., left to right) from an uphole perforating gun (e.g., perforating gun 310*a* on FIG. 3B) through the electrical feedthrough 306 portion of the bulkhead 305 to the contact pin 502 to the electrical contact 380 to a wire (not shown), from where it passes downhole to a detonator located on another end of the perforating gun (e.g., detonator 360*b* of perforating gun 310*b* shown on FIG. 3B). This way, the detonation signal may proceed downhole in a down-going fashion, as previously mentioned.

The contact pin 502 may be held in place by any suitable mechanism. For example, retaining nut(s) 504 are shown that serve to ensure that the contact pin 502 is centralized within the electrical feedthrough 306 of the bulkhead 305. As illustrated, contact pin 502 extends from a receptacle 560 formed in the first end of the bulkhead 305 through the electrical feedthrough 306 and to a second end of the bulkhead 305 into the end alignment 390. The receptacle 560 of the bulkhead 305 may be threaded. The contact pin 502 may comprise, for example, a sliding mandrel 508 and a spring 506 which ensures good and reliable electrical connection with the detonator 360 upon tubular make-up of the gun string (e.g., again referring to FIGS. 3A-3C). Other locking features, such as the internal O-ring 562, may further ensure good centralization of the contact pin 502 to ensure a reliable electric connection with the electrical contact 380. The O-rings 562 may provide internal sealing between upper and lower sections of a bore of bulkhead and a feedthrough pin insert. The positioning of the electrical contact 380 relative to the end alignment 390 and contact pin 502 is carefully controlled by various features of the electrical contact 380 during contact with the contact pin 502. Also visible is the charge tube 312 seated against the end alignment 390. Also shown on FIG. 5 are O-rings 564 disposed on an exterior of the bulkhead 305 that may be used to sealingly engage the bulkhead 305 with the perforating gun body 316

Alternate embodiments of the electrical contact 380 are also possible, for example, wherein the bends 522 are not identical (e.g., not having the same 2D distance 546, referring to FIGS. 5B, 5D); wherein the bends 522 span a different amount of distance than the diameter of the periphery 544 or the diameter 554 of the support plate 520 (e.g., referring to FIG. 5D); wherein the electrical contact 380 is made up of one single part or greater than two parts; wherein the electrical contact 380 has less than or greater than four fins on the support plate 520; wherein the fins are located somewhere other than the support plate 520 (e.g., the contact plate 518); wherein there are more than two plates 518, 520; wherein materials can be any electrically conductive material (e.g., carbon fiber(s)); and any combination of the foregoing.

Also shown by the figure is how at least a portion of the end alignment 390 may be seated within the charge tube 312. One purpose (among many) of the end alignment is to centralize the charge tube 312 within the gun body 316 such that the charge tube 312 and the gun body 316 do not touch. For example, the end alignment 390, which may be made of an electric insulating material (e.g., plastic) may physically and/or electrically separate the charge tube 312 from the gun body 316 such that the charge tube 312 is sheltered from the surrounding environment (e.g., the wellbore 110 of FIG. 1) of the perforating gun assembly (e.g., referring to FIG. 1). To that end, FIGS. 6A-6H show an end alignment 390 in more detail.

Figure 6A:
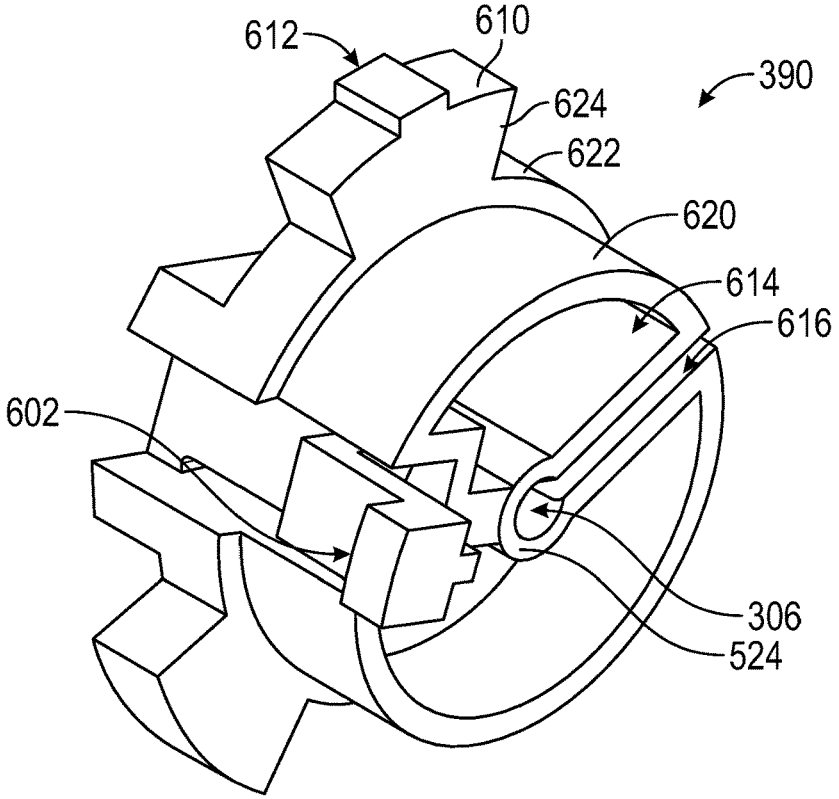
FIG. 6A is an isometric view of the end alignment, in accordance with some examples of the present disclosure.
Figure 6B:
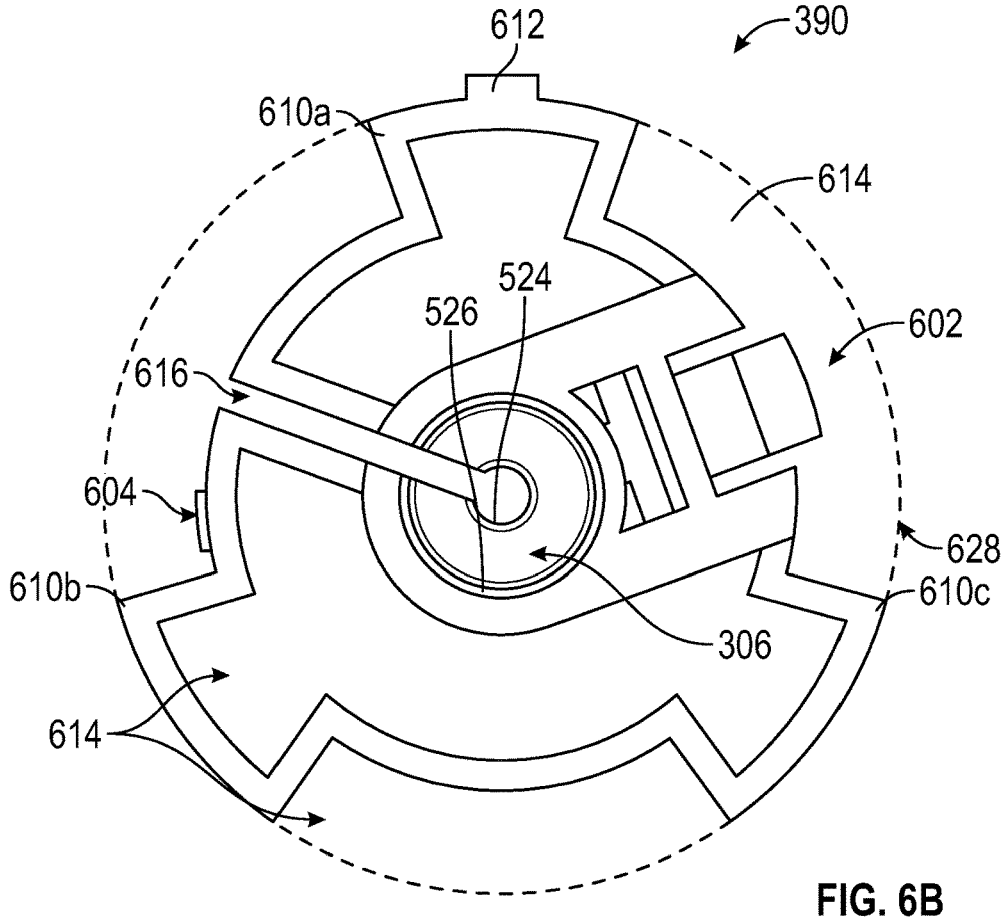
FIG. 6B is a downhole view of the end alignment, in accordance with some examples of the present disclosure.

FIG. 6A is an isometric view of the end alignment 390 with the electrical contact 380 and wire 346 omitted for reference, in accordance with one or more embodiments of the present disclosure. FIG. 6B is a downhole view of the end alignment 390 with the electrical contact 380 and wire 346 also omitted for reference, in accordance with one or more embodiments of the present disclosure. FIGS. 6A and 6B both show the stand-alone end alignment 390 without any of the other gun components which would typically be connected to it to form the perforating gun 310 (e.g., referring to FIG. 3A).

As shown and described in FIGS. 3C, 4H, 5A, and 5B, the perforating gun 310 comprises an end alignment 390. The end alignment 390 is a multipurpose device which, among other things, provides a secure space, through which the electrical detonation signal passes safely and unhindered by external influences (e.g., detonation, wellbore 110 of FIG. 1, etc.) to the electrical feedthrough 306 of the bulkhead 305. As discussed previously, the one or more internal regions, i.e., regions 524, 526, referring to FIG. 5B, of the end alignment 390 also allow the electrical contact 380 to be stably and centrally positioned to ensure good electrical contact with the contact pin 502.

The end alignment 390 may be unitarily formed as one piece, such as by injection molding, additive manufacturing (i.e., 3D printing), or the like. Alternatively, one or more components of the end alignment 390 (e.g., including the collet 602 and lug 604) may be separately attached to the end alignment 390, such as but not limited to over molding, fastening, snap fitting, or other methods of joining. The end alignment 390 may comprise any suitable electrically insulating material, such as plastic, provided that it has sufficient strength to resist breaking.

A periphery 628 of the end alignment 390 may define an outer diameter of end alignment 390. The periphery 628 may include a plurality of non-contiguous peripheral portions, e.g., cars 610*a*, 610*b*, 610*c*, etc., circumferentially spaced along a generally circular profile indicated by a dashed line at 628 that may conform to an inner diameter of a charge tube or other outer perforating gun component (e.g., gun body 316 of FIG. 3A).

As previously mentioned, the skeletonized body of the end alignment 390, i.e., having one or more significant portions removed as cut-outs 614, aids in material reduction while not significantly compromising integrity or functionality of the end alignment 390. This functionally limits the amount of material used, resulting in a smaller footprint, as well as the total cost (e.g., by as much as 30%) of the piece than what would otherwise be achieved without the skeletonizing of the end alignment 390. As illustrated, cut-outs 614 are also formed between cars 610*a*, 610*b*, 610*c*, etc., to reduce the amount of space occupied by the end alignment 390.

Also visible in FIGS. 6A and 6B is the wire routing slot 616, which allows for ergonomic placement of the wire 346 (e.g., 346*a*, 346*b*, referring to FIG. 3C) to the electrical contact 380 and/or placement of the electrical contact 380 and wire 346 to its appropriate position within the end alignment 390 during assembly.

As illustrated, the end alignment 390 may comprise a collet 602 and lug 604. The collet 602 and lug 604 may provide an ergonomic way to assemble which may, in some examples, not rely on external screws or fasteners that add time, additional cost, and difficulty of assembly. Specifically, the collet 602 and lug 604 facilitate assembly by allowing, for example, a single acceptable radial orientation of the end alignment 390 relative to a central axis of the charge tube 312 and/or perforating gun 310.

During assembly, the narrow portion 620 of the outer tubular body of the end alignment 390 is inserted into the charge tube 312 (e.g., referring to FIGS. 3A-3C, 5A) such that the collet 602 mates with (e.g., snaps into) an opening of the charge tube 312 and the lug 604 slides into another opening, e.g., a j-slot (to be shown and discussed in later figures), of the charge tube 312. At the interface between narrow portion 620 and wider portion 622 of the outer tubular body is a contact surface 624 which seats against the charge tube 312. In other words, the narrow portion 620 slides into the charge tube 312 until the charge tube 312 is stopped by the contact surface 624, at which point, the collet 602 and opening 608 are properly engaged.

All the disclosed methods of joining are an integral part in the design, however, while only a few specific configurations are shown, it should be understood that the scope of the present disclosure is intended to encompass any combination of the various features herein described. Alternative or additional fastening methods to the collet 602 and lug 604 may comprise, for example, interference fits, press fits, snap fit designs, living hinges, twist lock designs, transition fits, combinations thereof, and the like. In an alternative example, lug 604 may instead comprise more than one lug, e.g., a double lug. For example, two lugs may be spaced as a pair of lugs proximate the other. Alternatively, a first lug may be disposed on one circumferential location of the end alignment 390 and a second lug disposed on another circumferential location of the end alignment. Use in this manner may, in some examples, provide yet additional differential stability to the end alignment 390 and/or the one or more gun components attached thereto.

Figure 6C:
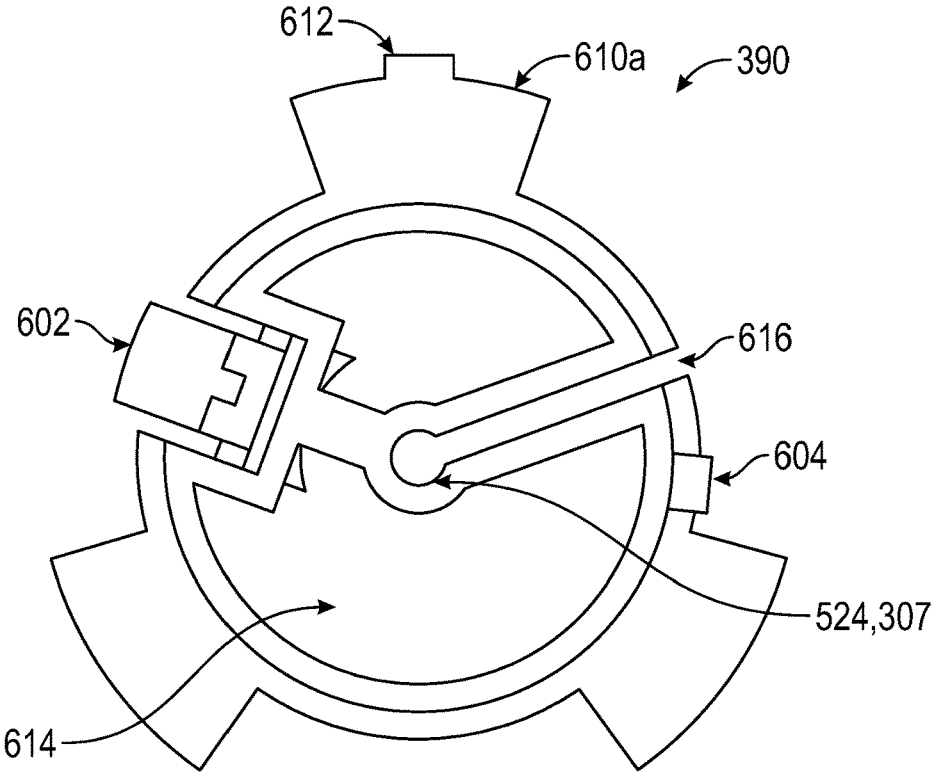
FIG. 6C is a view of the end alignment, in accordance with some examples of the present disclosure.

FIG. 6C is view of the end alignment 390 with the electrical contact 380 and wire 346 omitted for reference. FIG. 6C is identical to FIG. 6B, only that it is flipped around. As illustrated, at least part or the whole of the region indicated by cut-out 614 may be removed to reduce the amount of material needed for the manufacture of the end alignment 390. Also visible is the comparatively small inner diameter of the narrower region 524 of the electrical contact passthrough 307 of the end alignment 390. Also shown is the collet 602, lug 604, mating notch 612 atop ear 610*a*, and wire routing slot 616.

Figure 6D:
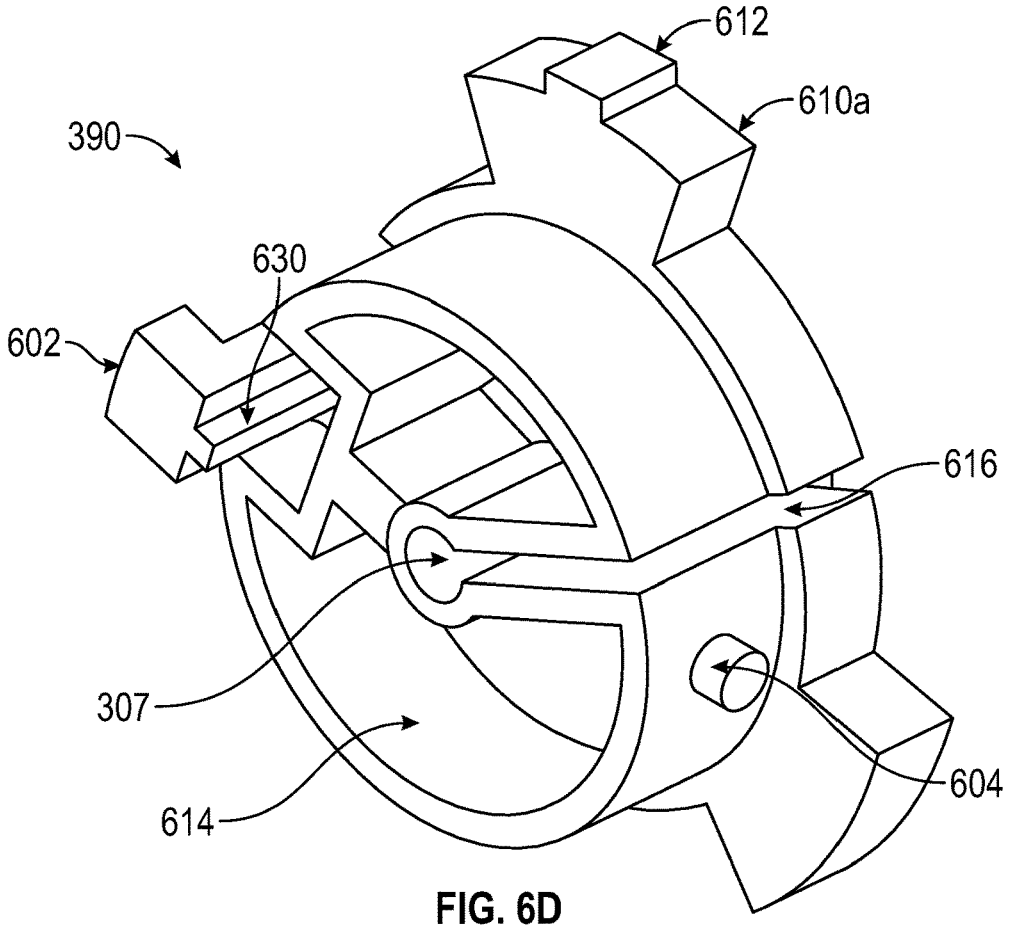
FIG. 6D is an isometric view of the end alignment, rotated by 90 degrees relative to FIG. 6A, in accordance with some examples of the present disclosure.

FIG. 6D is an isometric view of the end alignment 390 with the electrical contact 380 and wire 346 omitted for reference. FIG. 6D is identical to FIG. 6A, except that it is viewed as rotated by 90 degrees clockwise. As illustrated, the lug 604 is disposed on the side of the end alignment 390 substantially opposite the collet 602, however, may be placed at any circumferential location of the narrow portion 620 of the end alignment 390. Also visible is the wire routing slot 616, lug 604, electrical contact passthrough 307, collet 602, ear 610*a*, and mating notch 612. Visible in this view is a ridge 630 on the backside of the collet 602. Where used, ridge 630 may add rigidity to the collet and reduce stress concentration so that the collet does not break as easily as it might otherwise.

As mentioned previously, during assembly, the narrow portion 620 of the outer tubular body of the end alignment 390 is inserted into the charge tube 312 until the charge tube 312 is met by the contact surface 624 at the appropriate insertion distance. However, it is contemplated that an alternative configuration could be to have the narrow portion 620 be wider than the charge tube 312 so that the charge tube 312 instead inserts into the end alignment with the collet 602 flipped and the lug 604 disposed on an inner diameter of the outer tubular body of the end alignment 390 rather than on the outer diameter as illustrated. In such an embodiment, the narrow portion 620 (now modified to be the larger portion) of the outer tubular body of the end alignment 390 would fit around an outer surface of the charge tube 312, and the wider portion 622 (now the narrower portion) comprising the radial protrusion(s) 610 would still function as the "stop," i.e., contact surface 624, to limit over-insertion.

Figure 6E:
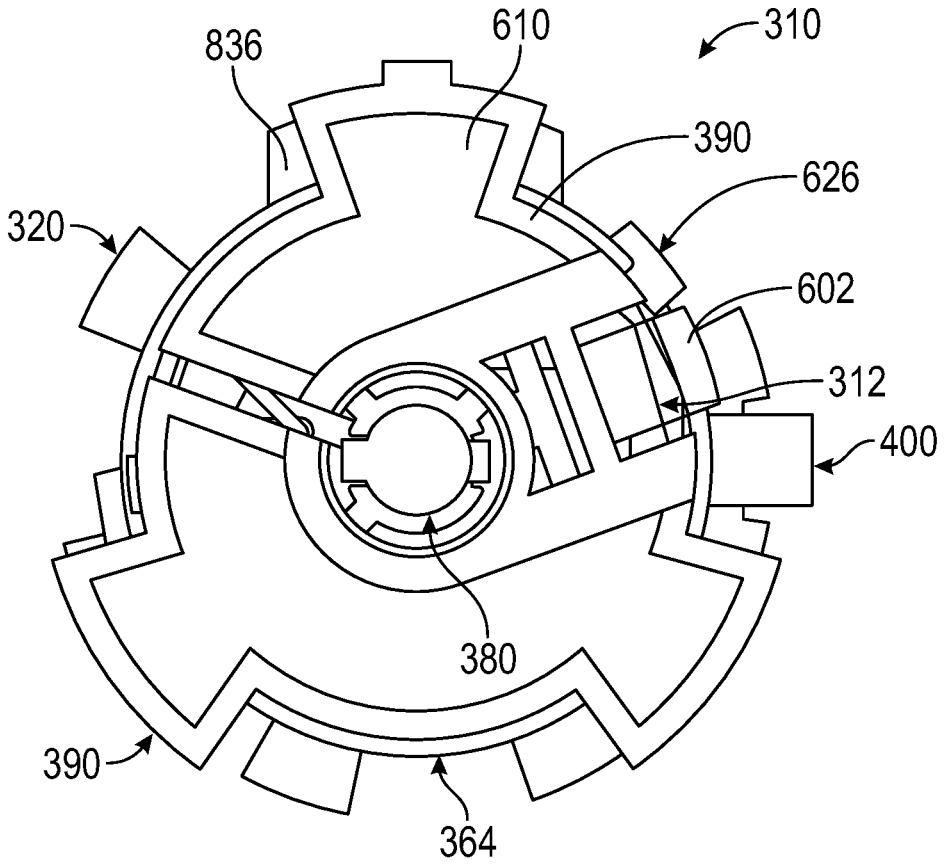
FIG. 6E is a downhole view of the perforating gun from the end alignment to the detonator housing, in accordance with some examples of the present disclosure.

FIG. 6E is a downhole view of the end alignment 390 coupled to a charge tube 312 which is coupled to a detonator housing 320. FIG. 6E is substantially similar to FIG. 6B, except that the grounding clip 400 is shown extending out from the detonator housing 320, the wire 364 and detonating cord are shown helically wrapped around the charge tube 312, the electrical contact 380 is shown disposed within the end alignment 390, the collet 602 is shown seated in its corresponding opening (e.g., opening 606 of FIG. 6F) of the charge tube 312, as well as the radial protrusions, i.e., cars 610*a*, 610*b*, 610*c* of the end alignment 390 and the radial protrusions, e.g., cars 836A, 836B, etc. of FIG. 8A, of the detonator housing 320. Also shown is a wire clip 626 used to secure wire 364 within/to the detonator housing 320. However, the bulkhead 305 and contact pin 502, which would be seated on or near the end alignment 390, is still omitted for reference. As illustrated, the end alignment 390 is assembled such that it is uphole from the detonator housing 320 and charge tube 312. For example, while the detonator housing 320 appears to be directly behind the end alignment 390 in this view, the charge tube 312 is still disposed between the end alignment 390 and the detonator housing 320.

Figure 6F:
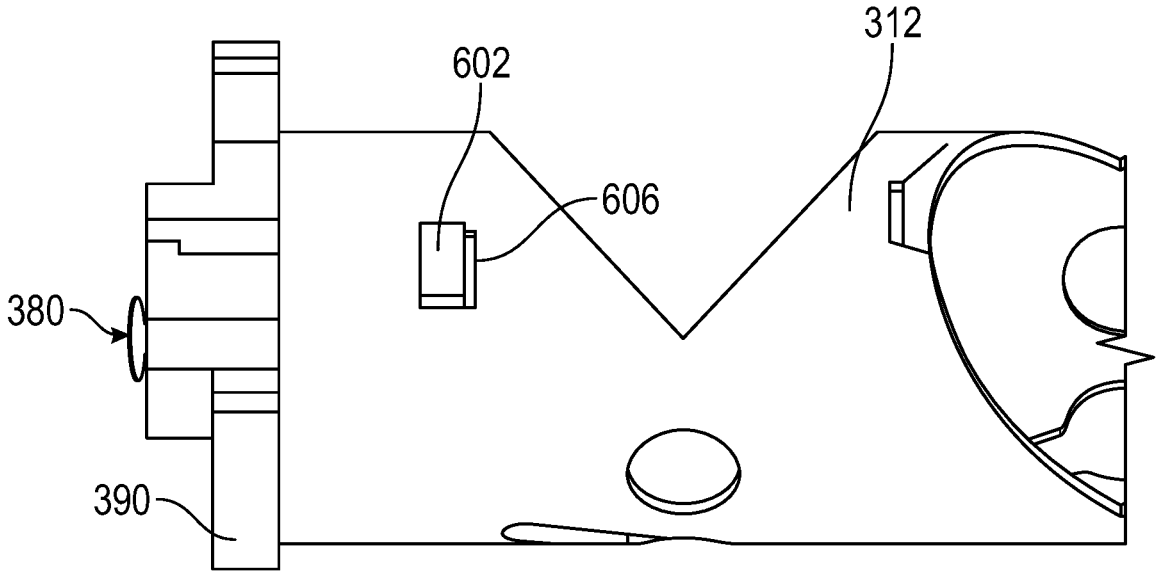
FIG. 6F is a side view of the interface between the end alignment and the charge tube to show a collet snapped into an opening, in accordance with some examples of the present disclosure.

FIG. 6F is a side view of the interface between the end alignment 390 and the charge tube 312. In the illustrated embodiment, the end alignment 390 and the charge tube 312 are interlocked. For example, the collet 602 of the end alignment 390 is snapped into the opening 606 of the charge tube 312. The openings 606, 608 (e.g., also referring to FIG. 6H) may be an aperture, slot (e.g., j-slot), or otherwise a materially formed receptacle or corresponding mating feature for interfacing with the collet 602 to interlock the end alignment 390 and the charge tube 312. Also easily discernible is the charge tube 312 seated against the end alignment 390, as well as how extend from the end alignment 390 is the electrical contact 380 in an uncompressed state. Upon attachment of the bulkhead 305 containing the contact pin 502 with the end alignment 390, the electrical contact 380 would be compressed such that the bends and contact plate 518 of the electrical contact 380 are housed at least in part or entirely within the electrical contact passthrough 307 portion of the end alignment 390 (e.g., referring to FIG. 5A).

Figure 6G:
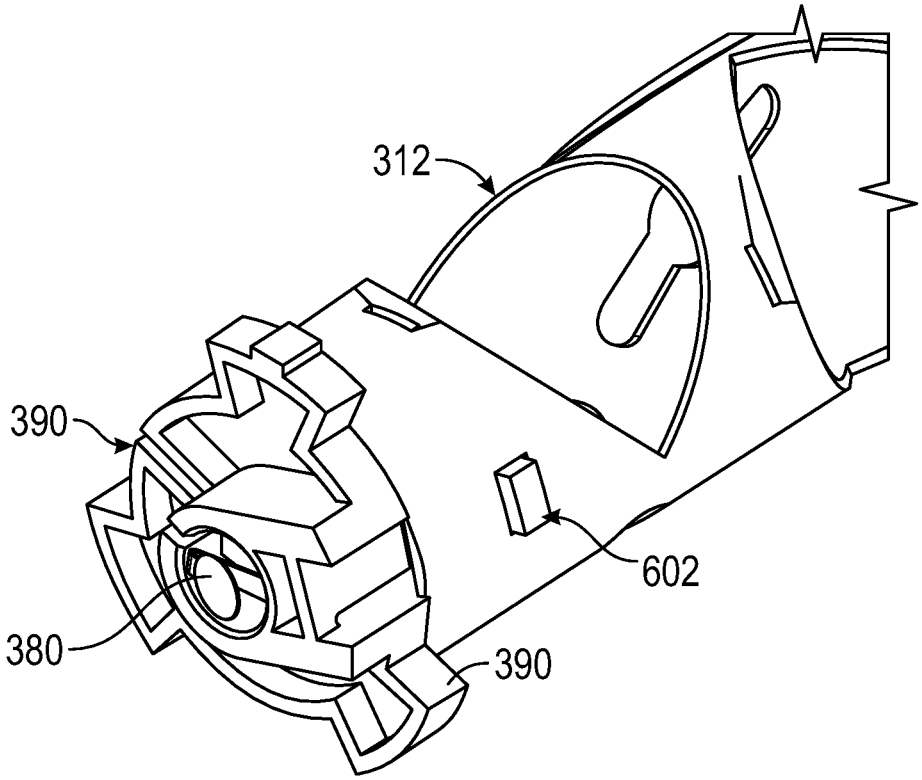
FIG. 6G is a perspective view of the end alignment and charge tube of FIG. 6F, in accordance with some examples of the present disclosure.

FIG. 6G is a perspective view of FIG. 6F, rotated counterclockwise 45 degrees. FIG. 6G likewise shows end alignment 390 interlocked with the charge tube 312. As illustrated, he collet 602 of the end alignment 390 may be snapped into the opening 606 of the charge tube 312 to interlock the end alignment 390 and the charge tube 312. Also shown are the cut-out sections of the end alignment 390 for skeletonizing of the end alignment 390.

Figure 6H:
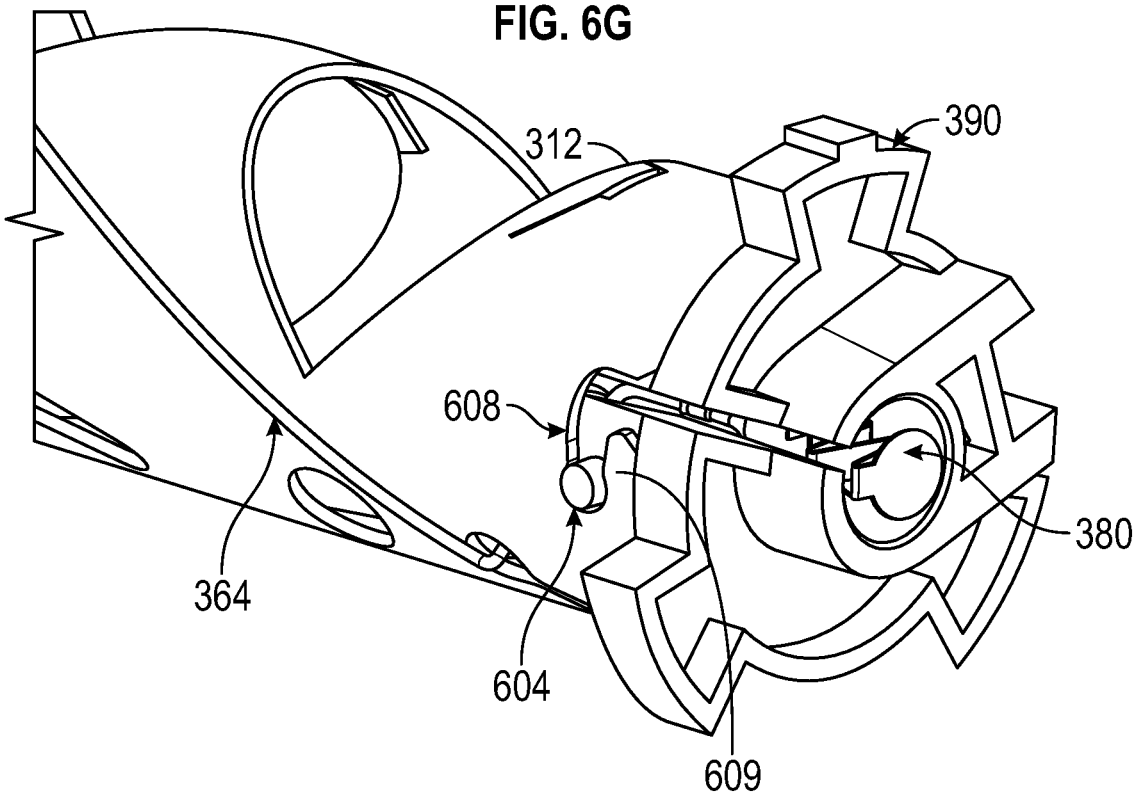
FIG. 6H is a perspective view of the end alignment and charge tube of FIG. 6G from the other side to show a lug seated in a j-slot, in accordance with some examples of the present disclosure.

FIG. 6H is a perspective view of FIG. 6F, rotated counterclockwise past 90 degrees. In this illustration, the lug 604 and opening 608 are visible, with the lug 604 fully seated in the opening 608 to interlock the end alignment 390 and the charge tube 312. In this example, opening 608 is a j-slot, having a non-linear profile to guide the lug 604 to its appropriate circumferential orientation relative to the charge tube 312. Also visible is a slight narrowing 609 of the opening 608 which may provide further resistance to counter rotation after assembly. As illustrated, the area of the slight narrowing 609 may be slightly narrower or approximately equal to the diameter of the lug 604, such that a small amount of force is required to fully seat the lug 604 past the slight narrowing 609 and into the opening 608. To fully engage the opening 608, the narrow portion 620 (e.g., referring to FIG. 6B) of the tubular body of the end alignment 390 is inserted into the charge tube 312 and rotated counterclockwise past the slight narrowing 609, at which point the collet 602 (e.g., referring to FIGS. 6F and 6G) is properly aligned. To uninstall the end alignment 390 from the charge tube 312 after assembly, a disassembler would, in some examples, manually push in the collet 602 and, while the collet 602 is in a depressed position relative to the opening 606, rotate the end alignment 390 clockwise to disengage the lug 604 from the opening 608. Use in this manner may allow the end alignment 390 to be releasably attached to the charge tube. It should be understood that while one specific configuration is illustrated in these figures, i.e., counter-clockwise engagement and clockwise disengagement of a j-slot with a collet at a specific location on the charge tube, other configurations are also possible, for example, clockwise engagement and counter-clockwise disengagement.

Likewise, it should be understood that the opening 608 and lug 604 may be located at various alternative circumferential position of the charge tube 312 to those shown by the figures. In some example configuration, the lug 604 itself may double as both the lug 604 and a collet 602, wherein the aperture is just past the end of the j-slot, and wherein the lug is configured (e.g., slanted or rounded) to slide into the aperture upon rotation of the end alignment 390 to its maximum stroke length. The end alignment 390 may also include various alternative features (e.g., double lug, dual collets, collet and lug combinations); various alternative electrical connections; various alternative detonator housing designs (e.g., different collet lengths, different methods of manufacturing, multi-part pieces, detonating cord stop feature of varying size, shape, location, number of protrusions); and collet 602 and lug 604 may be alternatively axially snapped into place, i.e., not twisted.

Figure 7A:
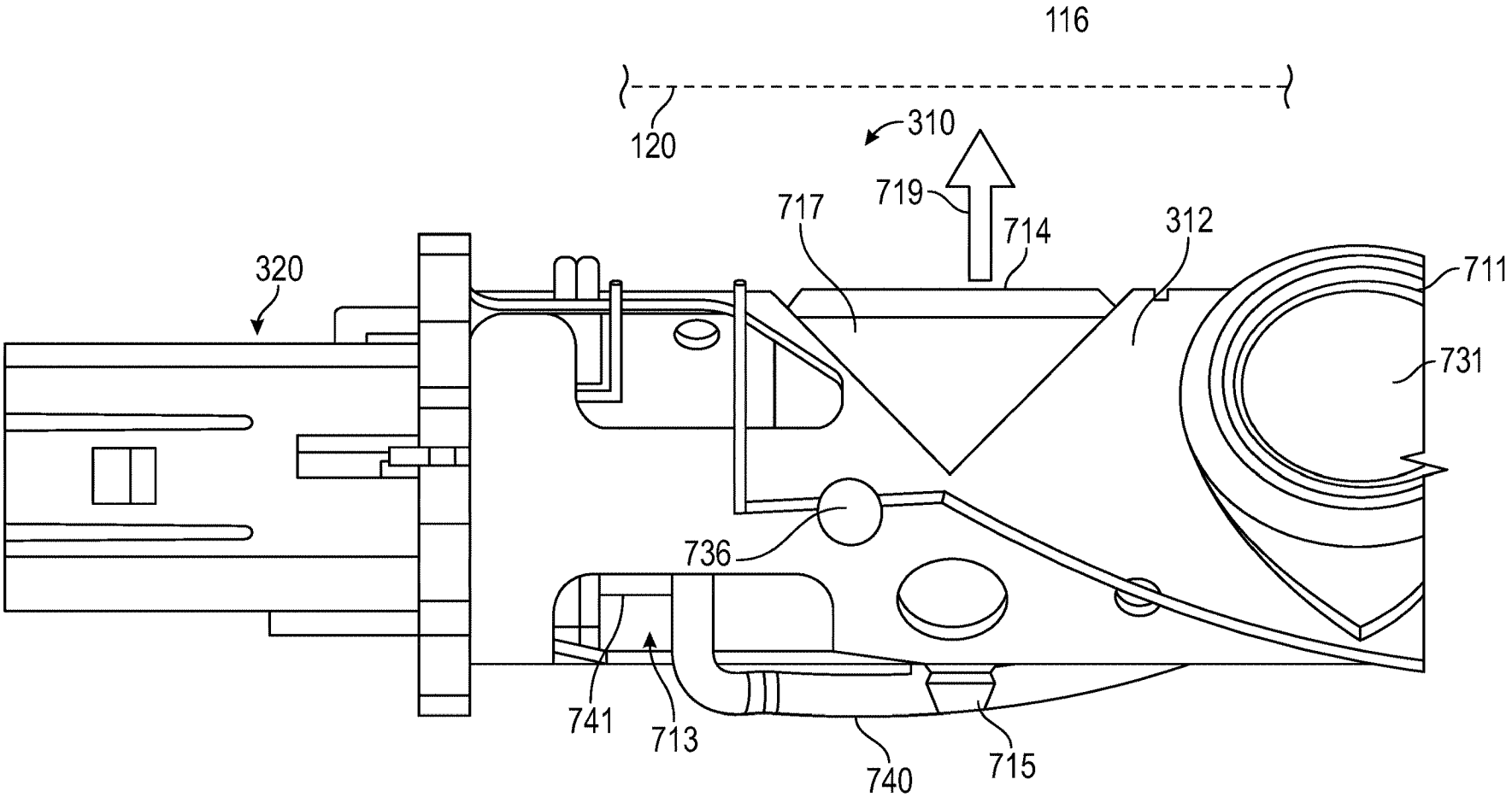
FIG. 7A is an enlarged side view of the detonator end of a perforating gun after a detonating cord has been installed and inserted into the detonator housing in accordance with some examples of the present disclosure.

FIG. 7A is an enlarged side view of the perforating gun 310 after a detonating cord 740 has been installed and inserted into the detonator housing 320. The detonating cord 740 may be arranged along the charge tube 312, such as by wrapping the detonating cord 740 around the charge tube 312 in a generally helical fashion and connecting the detonating cord 740 to each perforating section 714. Each perforating section 714 may include a charge case 717 containing an explosive charge for forming perforations in a borehole wall 120 (e.g., referring to FIG. 1) and an explosive booster at an initiation end 715. The explosive charge may be disposed within the charge case 717, for example, below the area indicated for a projectile (e.g., invertible metal conical liner) at 731 prior to lowering of the perforating tool assembly 102 (e.g., referring to FIGS. 1, 2, and 4). The explosive charge may be referred to as a "shaped charge" by virtue of a concave interior shape 711 of the charge case 717 that helps focus the explosive energy in a firing direction 319 directed toward the borehole wall 120. In one or more examples, the explosive charge may be configured to invert and launch a projectile 731 and into the formation 116 (e.g., referring to FIG. 1). The detonating cord 740 may be laterally attached to each perforating charge at the initiation end 715 in a configuration for passing the explosive detonation from the detonating cord 740 to the booster and to the shaped explosive within the charge case 717. An end portion 741 of the detonating cord 740 is inserted through an window 713 on the charge tube 312 and secured to the detonator housing 320. The window 713 is also one of a variety of features that facilitate visually confirming insertion of the detonating cord 740 at an appropriate insertion distance into the charge tube 312. Also visible in this figure is a wire fastener 736 which, in some examples, may secure one or more signal conductors to its appropriate orientation along the charge tube 312.

Figure 7B:
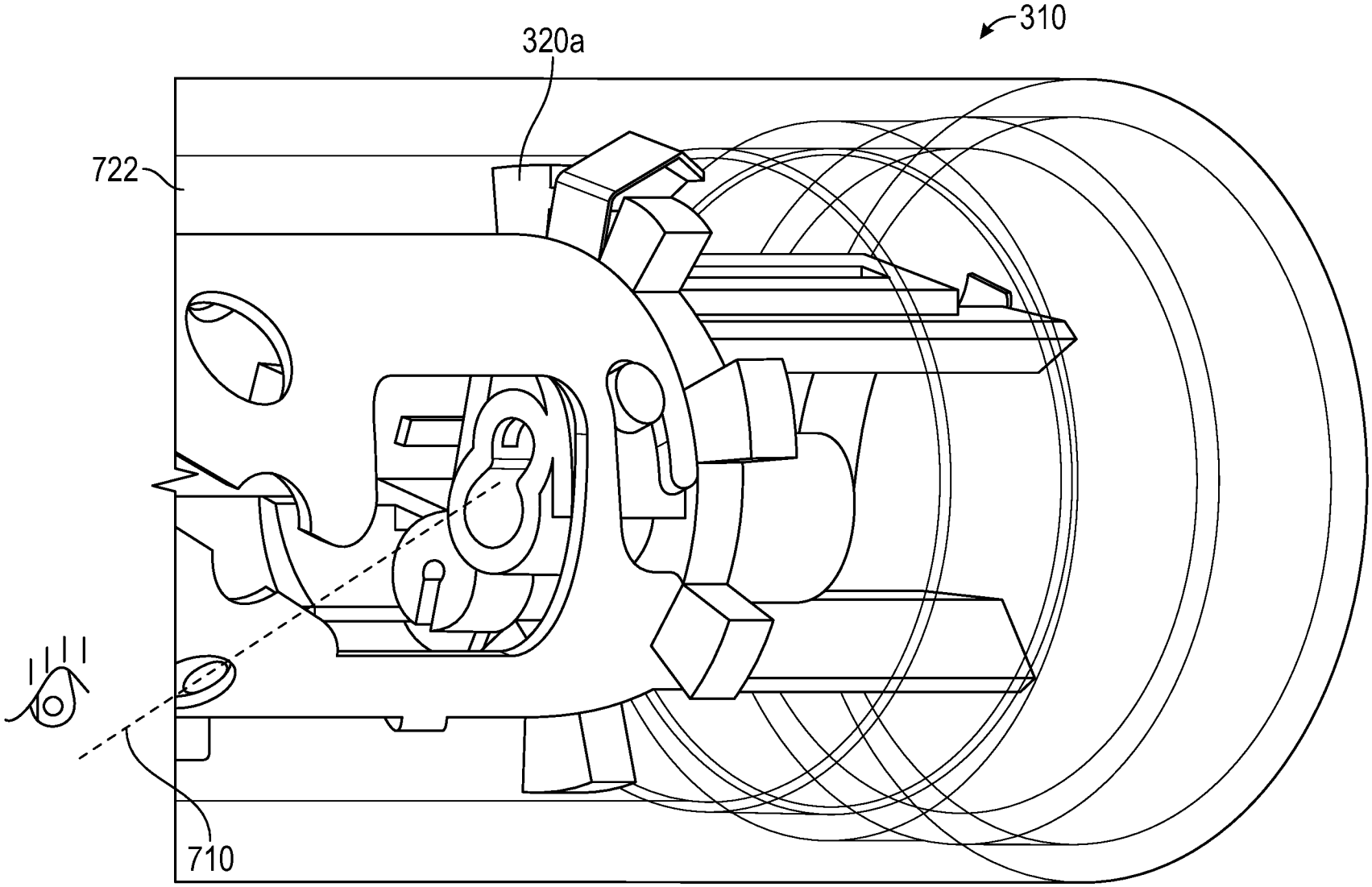
FIG. 7B is a perspective view of the perforating gun illustrating a first line of sight that may allow for visually confirming insertion of the detonating cord of FIG. 7A, in accordance with some examples of the present disclosure.

FIG. 7B is a semi-transparent view of the perforating gun 310 illustrating a first line of sight 710 that may allow for visually confirming insertion of the detonating cord 740 of FIG. 7A. The first line of sight 710 is looking toward the detonator housing 320, through the window 713, from a proximate end 722 of the detonator housing 320. In this view, a detonating cord receptacle 726 and a detonator receptacle 728 can be seen for receiving a respective detonator cord and detonator as further discussed in greater detail later.

These and other detonator components and assembly steps may be performed at least in part at a manufacturing facility, to reduce the number of steps to be completed in the field. Certain assembly steps, such as installing a detonator and making certain connections as part of the explosive train, may be deferred until the perforating gun 310 reaches the field, where the perforating gun 310 will be finally assembled and used. Deferring these steps helps avoid accidental detonation of the perforating sections 714 during transportation to the field. The actual order of assembly may vary due to the variety of different products that may incorporate these features, and the different markets, well sites, and so forth that will use the perforating gun 310. Regardless of location of assembly in the manufacturing facility or in the field, the assembler in the manufacturing facility, in the field, or wherever detonator components are installed will benefit from features that facilitate assembly. For example, features of the detonator housing 320 further disclosed below will help the assembler insert the end portion 741 of the detonating cord 740 to the proper depth and ensure the detonating cord 740 is fully and securely seated in the detonator housing 320.

FIG. 7A is an enlarged side view of the perforating gun 310 after a detonating cord 740 has been installed and inserted into the detonator housing 320. The detonating cord 740 may be arranged along the charge tube 312, such as by wrapping the detonating cord 740 around the charge tube 312 in a generally helical fashion and connecting the detonating cord 740 to each perforating section 714. Each perforating section 714 may include a charge case 717 containing an explosive charge for forming perforations in a borehole wall 120 (e.g., referring to FIG. 1) and an explosive booster at an initiation end 715. The explosive charge may be referred to as a "shaped charge" by virtue of a concave interior shape 711 of the charge case 717 that helps focus the explosive energy in a firing direction 319 directed toward the borehole wall 120. The detonating cord 740 may be laterally attached to each perforating charge at the initiation end 715 in a configuration for passing the explosive detonation from the detonating cord 740 to the booster and to the shaped explosive within the charge case 717. An end portion 741 of the detonating cord 740 is inserted through an window 713 on the charge tube 312 and secured to the detonator housing 320. The window 713 is also one of a variety of features that facilitate visually confirming insertion of the detonating cord 740 into the charge tube 312.

FIG. 7B is a perspective view of the perforating gun 310 illustrating a first line of sight 710 that may allow for visually confirming insertion of the detonating cord 740 of FIG. 7A. The first line of sight 710 is looking toward the detonator housing 320, through the window 713, from a proximate end 722 of the detonator housing 320. In this view, a detonating cord receptacle 726 and a detonator receptacle 728 can be seen for receiving a respective detonator cord and detonator as further discussed below.

These and other detonator components and assembly steps may be performed at least in part at a manufacturing facility, to reduce the number of steps to be completed in the field. Certain assembly steps, such as installing a detonator and making certain connections as part of the explosive train, may be deferred until the perforating gun 310 reaches the field, where the perforating gun 310 will be finally assembled and used. Deferring these steps helps avoid accidental detonation of the perforating sections 714 during transportation to the field. The actual order of assembly may vary due to the variety of different products that may incorporate these features, and the different markets, well sites, and so forth that will use the perforating gun 310. Regardless of location of assembly in the manufacturing facility or in the field, the assembler in the manufacturing facility, in the field, or wherever detonator components are installed will benefit from features that facilitate assembly. For example, features of the detonator housing 320 further disclosed below will help the assembler insert the end portion 741 of the detonating cord 740 to the proper depth and ensure the detonating cord 740 is fully and securely seated in the detonator housing 320.

Figure 7C:
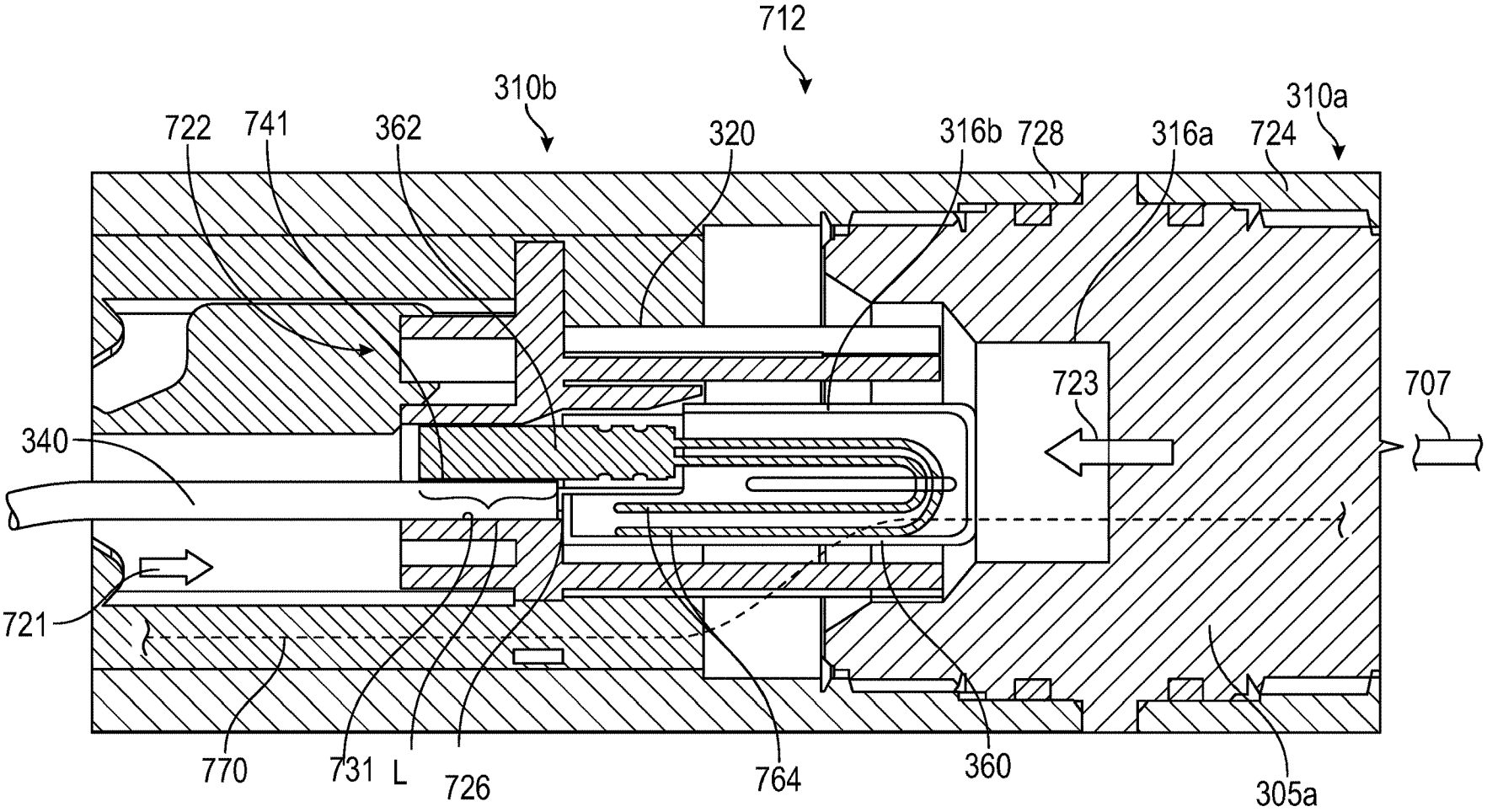
FIG. 7C is sectional side view of a perforating gun of FIGS. 3B, coupled end to end with a second perforating gun as part of a perforating gun string in accordance with some examples of the present disclosure.

FIG. 7C is sectional side view of the perforating gun 310*a* of FIGS. 3A and 3B, coupled end to end at the interface 712 (e.g., referring to FIG. 4) with a second perforating gun 310*b* as part of a perforating gun string, i.e., perforating tool assembly 102 (e.g., referring to FIG. 1), in accordance with one or more embodiments. The two perforating guns 310*a* and 310*b* are interconnected at their respective gun bodies 316*a*, 316*b* by any suitable connection type, e.g., threaded connections. A bulkhead 305*b* provides a physical barrier between the internal cavities of adjacent perforating gun bodies while providing electrical pathways therethrough. This may allow, in some examples, the perforating tool assembly 102 to quickly relay the detonation signal to the next gun while still maintaining good separation between the potentially high-pressure environments of the perforating guns 310*a*, 310*b* during detonation. Any number of additional perforating guns (not shown) may also be added to the perforating tool assembly 102.

In operation according to one or more examples, a detonation signal is relayed from a source (e.g., uphole electronics) down to the detonator 360. From the detonator 360, the detonation signal may proceed downhole to the next perforating gun 310*a* through the electrical feedthrough while detonating the explosive charges of the first perforating gun 310*b* in an up-going fashion. It should be understood that while detonating of the various perforating guns of the perforating tool assembly 102 (e.g., referring to FIGS. 1, 2, 4) may occur in a generally down-going fashion, detonation of the explosive charges of each perforating gun 310*a*, 310*b* may occur in an up-going fashion, as illustrated in the present example. Use in this manner may, in some examples, prevent a situation where the actual detonation outpaces the detonation signal, which would potentially interfere with signal transmission from gun to gun along the perforating tool assembly 102. This may ensure reliable detonation in some examples.

With continued reference to FIG. 7C, the perforating gun 310*a* has been further assembled by inserting the detonating cord 740 in one insertion direction 721 from a proximal end 722 of the detonator housing 320*a* and inserting the detonator 360 in an opposing insertion direction 723 from a distal end 724 of the detonator housing 320. The detonator receptacle 728 and detonating cord receptacle 726 are thus oppositely facing to receive the detonator 360 and detonating cord 740 from the opposing insertion directions 721, 723. The end portion 741 of the detonating cord 740 is received within a detonating cord receptacle 726 on the proximal end 722. A portion of the detonator 360 referred to as the explosive initiator 362 is received by a detonator receptacle 728 on the distal end 724 of the detonator housing 320. The explosive initiator 362 may comprise an explosive material inside a shell, wherein the shell is configured to fit closely within the detonator receptacle 728. With the detonating cord 740 fully seated within the detonating cord receptacle 726, and with the explosive initiator 362 of the detonator 360 fully seated within the detonator receptacle 728, the detonating cord 740 and explosive initiator 362 of the detonator 360 overlap by a desired overlap length "L", i.e., the detonating cord 740 and detonator 360 are in a side-by-side arrangement along this length L. The length "L" may be, for example, between 0.1 millimeters and 5 centimeters, or any ranges therebetween. The length "L" is of sufficient length to provide sufficient overlap between detonating cord 740 and detonator 360 to perform side-by-side detonation.

The detonator 360 is a part of the explosive train used to trigger an explosion of the perforating charges. The detonator 360 may generally comprise the explosive initiator 362, a body, one or more wires 764, and optionally, a wire clip. The detonator 360 may energize the detonation cord 340 to detonate the explosive charges upon receiving a detonation signal transmitted downhole to wires 764. For example, the detonation signal may be transmitted down a wireline schematically indicated at 707 to the perforating gun 310*b* from the surface of a wellsite. The explosive initiator 362 of the detonator 360 received into the detonator receptacle 728 may include a small amount of explosive material responsive to the electric signal. The explosive material may comprise a primary explosive and a secondary explosive. The primary explosive may be extremely sensitive to stimuli, such as an electrical signal in this case. The secondary explosive is typically a larger quantity of less sensitive explosive material that is triggered by the primary explosive. Any suitable explosive material can be used, as a variety of explosive materials for use in detonators are generally available. The overlap L ensures reliable transfer of detonation energy from the detonator 360 to the detonating cord 740. The detonating cord receptacle 726 also limits insertion as further discussed below to prevent further insertion of the detonating cord 740. Even without being able to see the end portion 741 of the detonating cord 740, the assembler can push the detonating cord 740 as far as it will go until it is fully seated, and thus be assured that the detonating cord 740 has been inserted to the intended depth and associated overlap L.

Thus, when the perforating gun 310 is assembled, the string of shaped charges is electrically connected inside the perforating gun bodies with the common detonation cord 340 used to explosively detonate the shaped charges in response to a detonation signal. The detonation cord 340 is connected to the detonator 360 housed in the perforating gun body 316. The detonator 360 may energize the detonation cord 340 to detonate the explosive charges within the respective perforating gun body 316 upon receiving the detonation signal. A separate signal conductor schematically indicated at 770 is formed through each perforating gun body 316*a*, 316*b*. The signal conductors 770 may comprise, for example, wire 346 (e.g., referring to FIG. 3), a flexible wire, an electric trace, or a ribbon, that is routed along each perforating gun body 316*a*, 316*b* to a signal input on each detonator 360. In one or more examples, one or more signal conductors 770 may be wrapped helically around the charge tube 312. The signal conductors 770 are interconnected via the connection between each pair of adjacent perforating guns to form a continuous signal path for communicating electrical signals from the wireline 707, along the perforating tool assembly 102, and to each detonator 360. The location of the detonator 360, and the routing of the detonating cord 740 and signal conductors 770 within each perforating gun body 316*a*, 316*b*, are illustrated by way of example and may vary according to the design of the perforating gun selected.

Figure 7D:
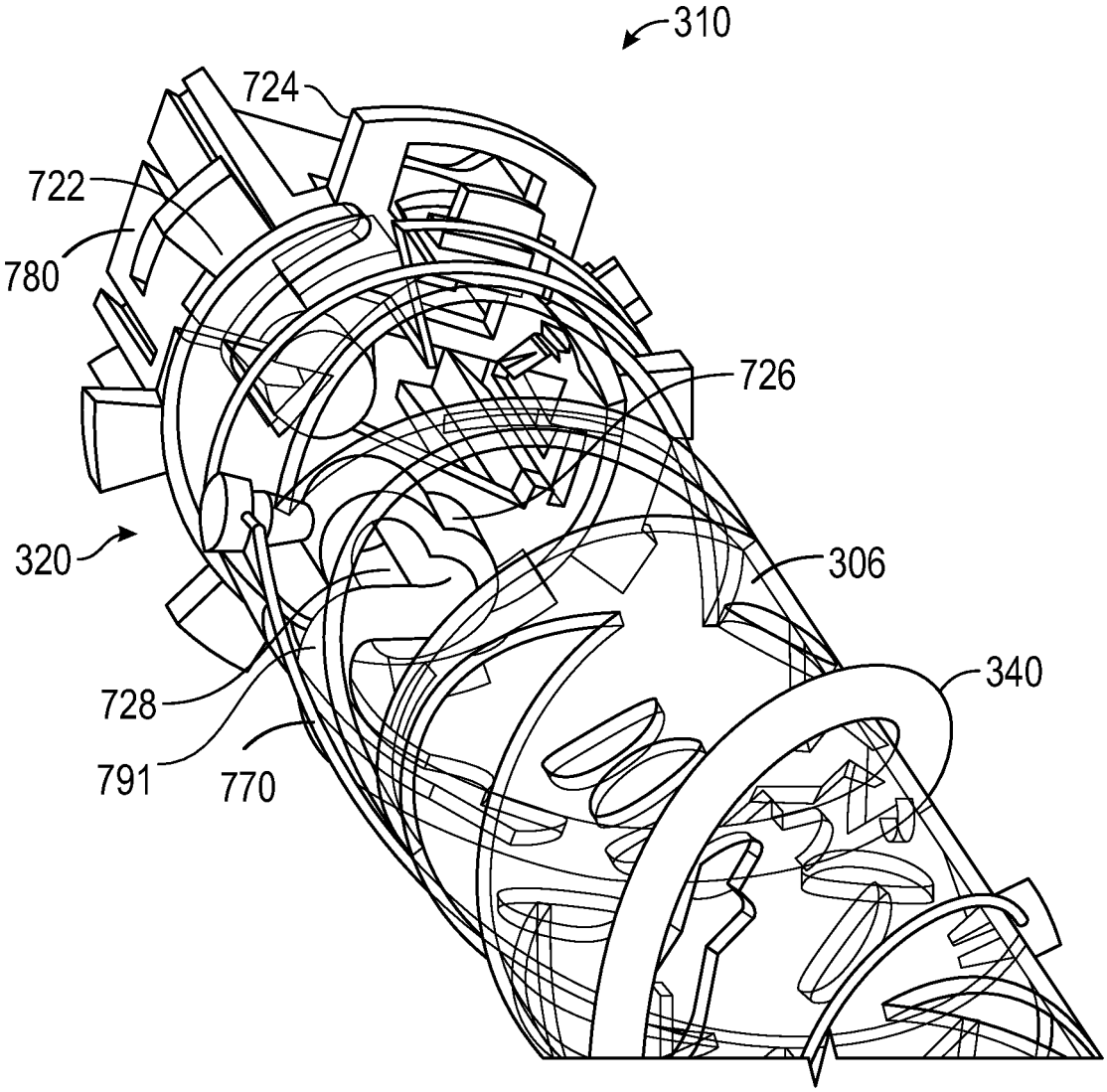
FIG. 7D is a perspective view of the perforating gun rotated away from the orientation of FIG. 7C, in accordance with some examples of the present disclosure.

FIG. 7D is a semi-transparent view of the perforating gun 310 rotated away from the orientation of FIG. 7C to show various features from another angle. It can be seen, for example, how the detonating cord 740 is wrapped in an optionally helical arrangement about the charge tube 312 and how the end portion 741 of the detonating cord 740 enters the detonating cord receptacle 726. The detonator (e.g., detonator 360 of FIG. 7C) is omitted for reference in this view so that the detonator receptacle 728 is shown unoccupied. This view provides another perspective of how the detonating cord receptacle 726 is generally aligned with the detonator receptacle 728 in a parallel, side-by-side arrangement. Also visible is the detonator housing 320, signal conductor 770 (e.g., wire) wrapped helically around the charge tube 312, a male end 780 of a "click-lock" type fastener, as well as the proximate end 722 of the detonator housing 320. The distal end 724 would be visible when viewed from behind the detonator housing 320 relative to the perspective shown in the figure. Also, as illustrated, the detonating cord 340 may be wrapped around the charge tube 312, except for where it enters through an aperture of the charge tube 312 at the bend 791 so that it may be routed from without the charge tube 312 to within the charge tube 312 and to the detonating cord receptacle 726.

Figure 8A:
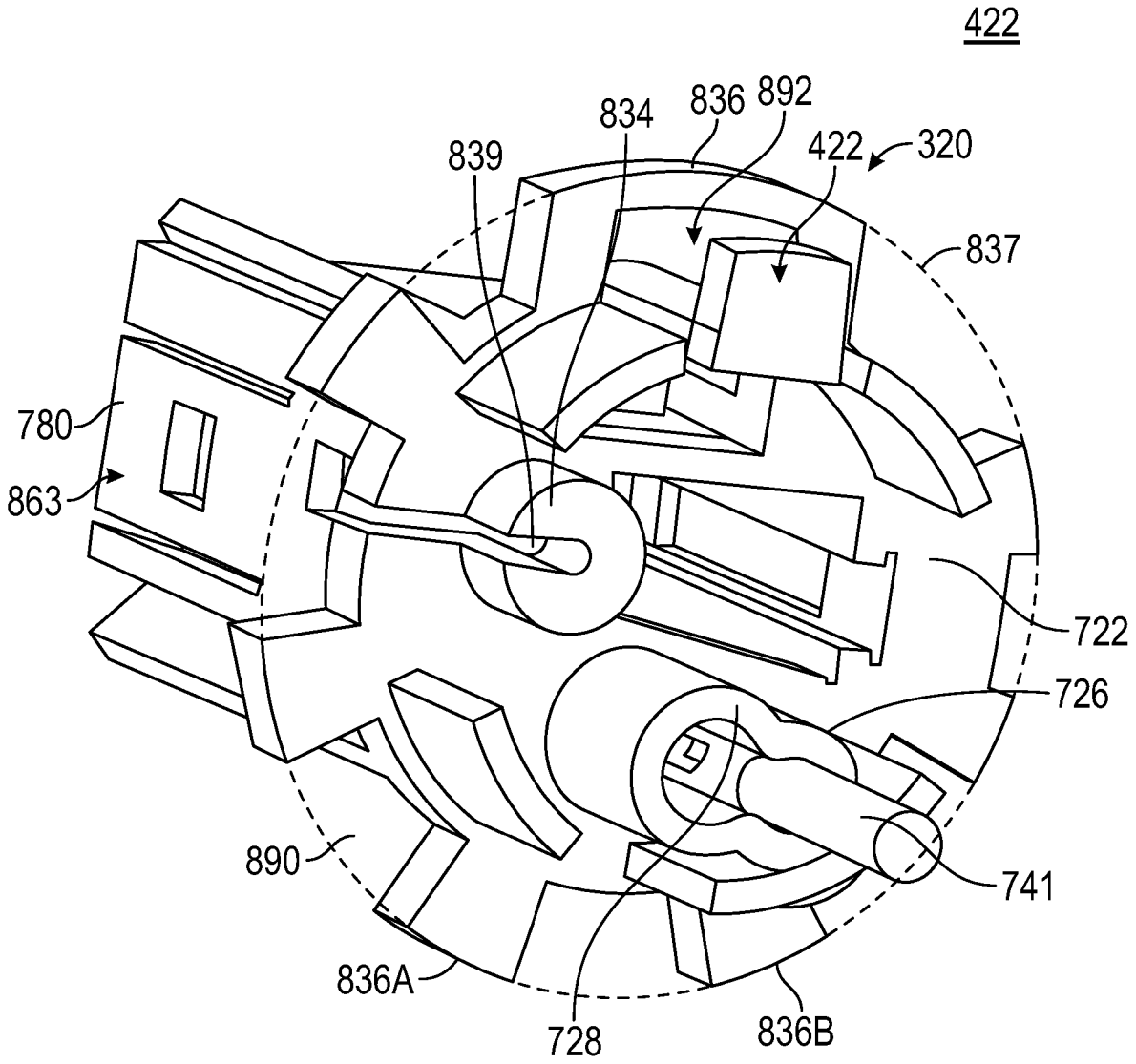
FIG. 8A is a perspective view of the detonator housing facing the proximate end, with the charge tube and other components of FIG. 7D omitted, in accordance with some examples of the present disclosure.

FIG. 8A is a perspective view of the detonator housing 320 (e.g., referring to FIGS. 3A-3G) facing the proximate end 722, with the charge tube and other components of FIG. 7D omitted for discussing certain example features of the detonator housing 320, in accordance with one or more embodiments. These other features include a click-lock type fastener 863 for releasably securing a body of the detonator housing 320 within the charge tube 312 of FIGS. 3A-3G. A raised boss 434 with a pin hole 839 is provided for receiving an electrical pin (not shown) for electrically coupling components of an electrical communication pathway along the perforating gun and/or gun string. The electrical pin may serve to electrically couple one or more electrical conduits (e.g., wires) to an electrical feedthrough of the bulkhead, wherethrough a signal may proceed from gun to gun of the perforating tool assembly 102 (e.g., referring to FIG. 1). A periphery 836 of the detonator housing 320 may define an outer diameter of the detonator housing 320. The periphery 836 may include a plurality of non-contiguous peripheral portions, e.g., cars 836A, 836B, etc., circumferentially spaced along a generally circular profile indicated by a dashed line at 837 that may conform to an inner diameter of a charge tube or other outer perforating gun component. The end portion 741 of the detonating cord is shown partially inserted into the detonating cord receptacle 726.

As mentioned, a "click-lock" type fastener 863 may releasably secure a body of the detonator housing 320 within the charge tube 312 of FIGS. 3A-3G. The click-lock type fastener 863, part of which is also visible in each of FIGS. 3C, 3D, and 3G, may be unitarily formed as part of the detonator housing 320, or else made up of one or more separate pieces. The click-lock type fastener 863 may have a male end 780 to clip into a receiving end (not shown) of the charge tube 312, or vice versa.

Figure 8B:
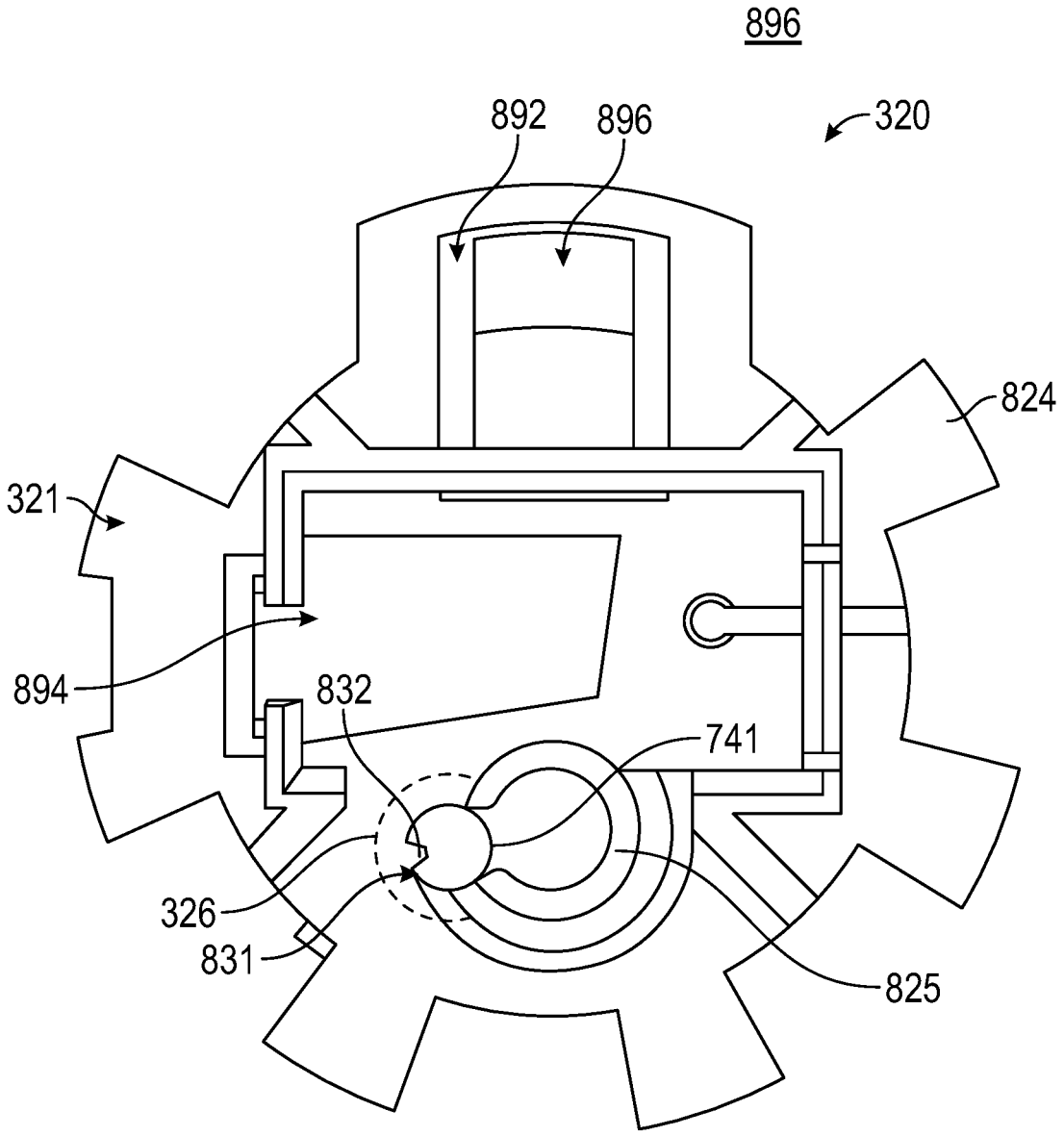
FIG. 8B is an end view of the detonator housing as viewed from the distal end of FIG. 8A with the end portion of the detonating cord inserted for reference, in accordance with some examples of the present disclosure.

FIG. 8B is an end view of the detonator housing 320 facing the distal end 724 (i.e., flipped around from FIG. 8A) with the end portion 741 of the detonating cord inserted for reference, in accordance with one or more embodiments of the present disclosure. This view shows one example configuration of a detonating cord stop 831 formed on the detonating cord receptacle 726 (shown by a dotted line) to limit an insertion depth of the detonating cord within the detonating cord receptacle 726, i.e., a depth locating feature. The detonating cord stop 831 comprises a single inward radial protrusion 832 in this example, but may include additional (i.e., a plurality of) radial protrusions circumferentially spaced around the detonating cord receptacle 726 to limit insertion of the end portion 741 of the detonating cord from the proximal end 722 of FIG. 8A. The radial protrusion 832 can be unitarily formed as part of the detonating cord receptacle 726, along with any of the other features, such as by injection molding, additive manufacturing (i.e., 3D printing), or the like. Alternatively, the detonating cord stop 831 may comprise a separate piece housed within or attached to the detonating cord receptacle 726, such as but not limited to over molding, fastening, snap fitting, or other methods of joining. The detonator receptacle 728 is shown with the detonator omitted in this view. The detonator receptacle 728 may also include a detonator stop 825 of any suitable configuration to similarly limit insertion of the explosive initiator 362 of the detonator from the proximal end 824. In the example shown, the detonator stop 825 is a depth locating feature similar to detonating cord stop 831 and is a single circumferential inward protrusion that partially covers the detonator receptacle 728. Partial covering the detonator receptacle 728 with the detonator stop 825 (e.g., allowing for an unobscured portion) may allow, in some examples, for the assembler to view from the proximate end if the detonator is inserted to its appropriate insertion distance.

Figure 8C:
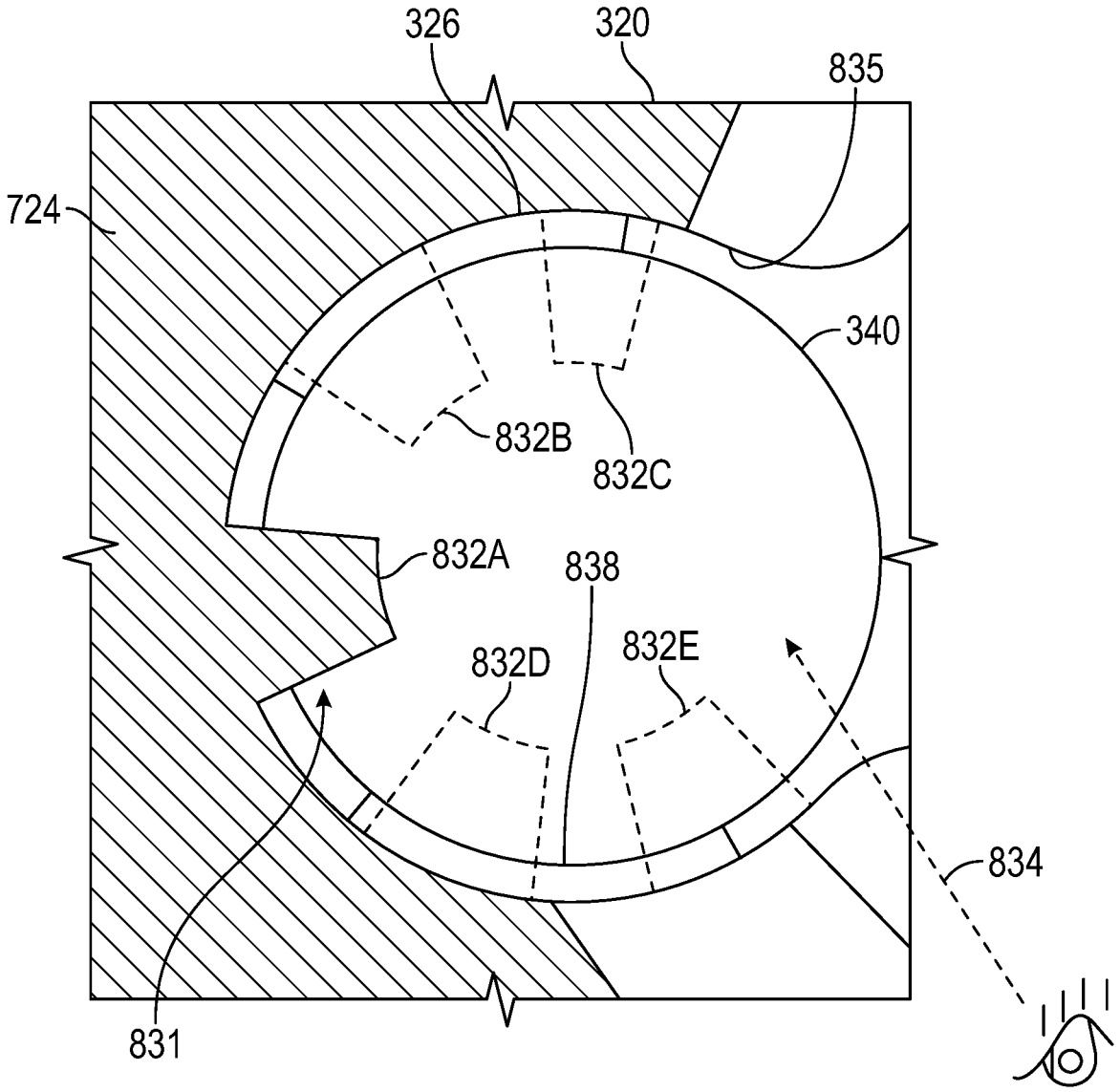
FIG. 8C is an enlarged end view of the detonator housing as viewed from the distal end of FIG. 8A, wherein the detonating cord stop comprises one or more inward radial protrusions, in accordance with some examples of the present disclosure.

FIG. 8C is an enlarged end view of the detonating cord receptacle 726 of detonator housing 320 as viewed from the distal end 724 of FIG. 8A, wherein the detonating cord stop 831 comprises one or more radial protrusions 832A-832E to limit the insertion depth of the detonating cord 740, in accordance with one or more embodiments. Again, the detonating cord stop 831 (e.g., referring to FIG. 8B) may include as few as one radial protrusion 832A as shown in solid line type. The detonating cord stop 831 may alternatively include a plurality of inward radial protrusions, e.g., 832A-832E, circumferentially spaced about a circular opening 835 of the detonating cord receptacle 726. The detonating cord stop 831 at least partially covers the opening 835 and has sufficient strength and rigidity to prevent the detonating cord 740 from being easily inserted beyond the detonating cord stop 831. The portion of the opening 835 not obscured by the detonating cord stop 831 provides a second line of sight schematically indicated at 834, to allow an assembler, as viewing from the distal end 724, to visually confirm when the detonating cord 740 has been fully inserted. Thus, the assembler(s) has/have at least two lines of sight, one from the proximal end and one from the distal end, to help visually confirm seating of at least the detonating cord 740, and optionally, the explosive initiator 362 (e.g., referring to FIG. 7C).

As another optional feature of the detonating receptacle 726, one or more ribs 838—in this case, two ribs—are provided to help guide insertion of the detonating cord 740. The ribs 838 protrude radially far enough into the opening 835 to frictionally engage the detonating cord 40 while still allowing the detonating cord 740 to be slid beyond the ribs 838 axially until it engages with the radial protrusion(s) 832 of the detonating cord stop 831. The ribs 838 can help secure the end portion of the detonating cord 740 within the opening 835, at least by virtue of this frictional engagement, so as to prevent the detonating cord 740 from being accidentally removed from the detonating cord receptacle 726. Preventing accidental removal from detonating cord receptacle 726 may be important, as subsequent detonation of the next perforating gun in a gun string (perforating gun assembly) may be interrupted in some examples by an improperly installed detonation cord 340, resulting in an incomplete detonation of the detonation train. In addition, preventing over-insertion of the detonating cord 740 with the detonating cord stop 831 may also help ensure good detonation and thus complete detonation of the detonation train by preventing the detonating cord 740 from being inserted too far into detonating cord receptacle 726. For example, if only the end of the detonating cord 740 is the active region of the detonating cord 740, (e.g., due to insulation material wrapped around inactive regions), over-insertion of the detonating cord 740 may similarly result in a failure to detonate just as in the case of insufficient insertion. Another function potentially served by the ribs 838 is to apply a normal force to the detonating cord 740 when it is side by side with and pressed up against the initiator. This may ensure good contact between the detonating cord 740 and the detonator to ensure good detonation.

Figure 8D:
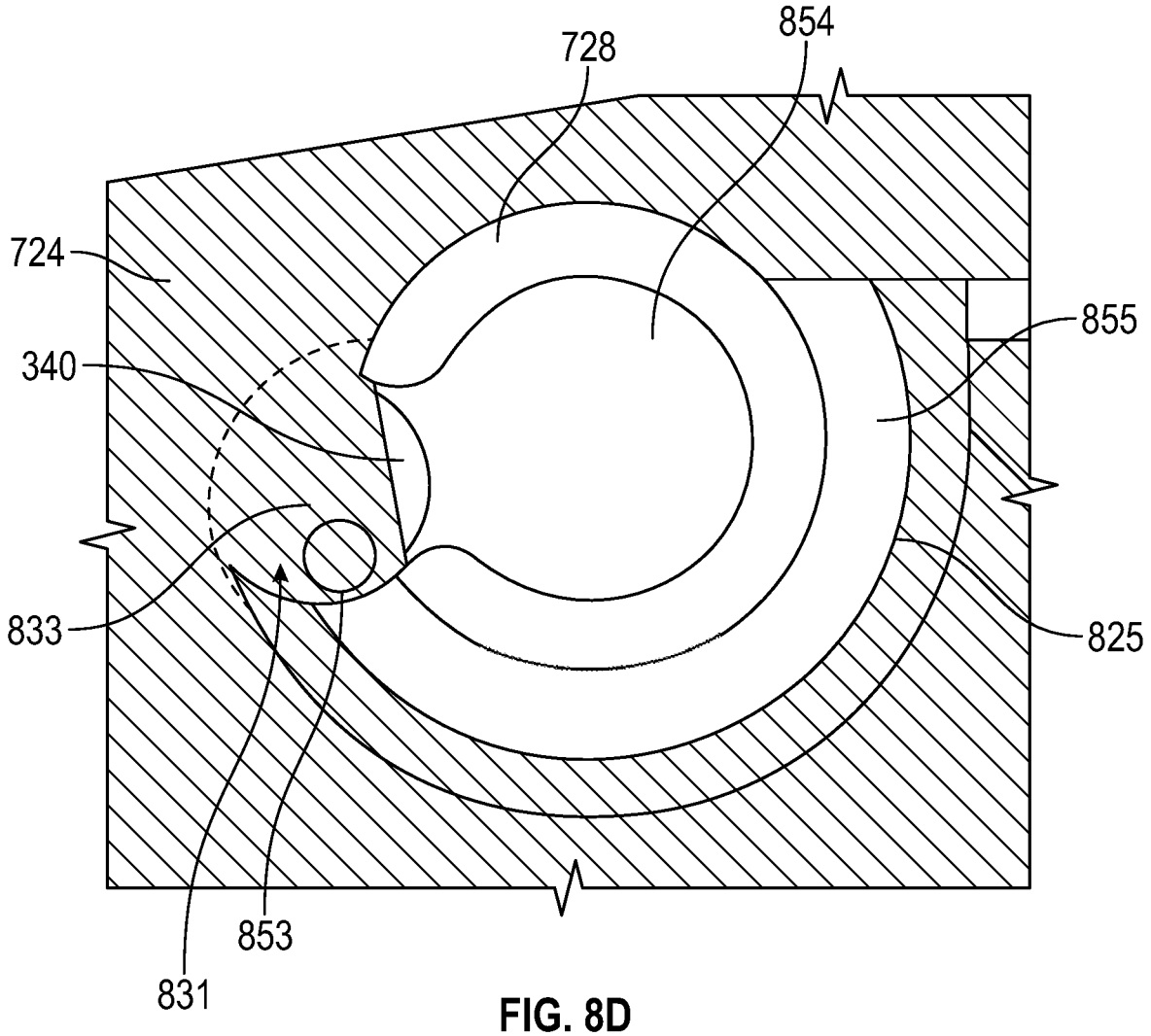
FIG. 8D is an enlarged end view of the detonator housing as viewed from the distal end of FIG. 8A, wherein the detonating cord stop comprises one or more thin webs, in accordance with some examples of the present disclosure.

FIG. 8D is an enlarged end view of the detonator housing 320 as viewed from the distal end 724 of FIG. 8A and showing both detonating cord receptacle 726 and detonator receptacle 728, in accordance with one or more embodiments. In the example shown by this figure, rather than inward radial protrusion(s) 832A-832E, the detonating cord stop 831 alternatively (or additionally) comprises a thin web 833 that functions in a similar manner to limit insertion of the detonating cord 740 past the detonating cord stop 831. As with the inward radial protrusion(s) 832A-832E, the thin web 833 has sufficient strength and rigidity to prevent the detonating cord 740 from being easily inserted beyond the detonating cord stop 831. The thin web 833 may at least partially cover the opening 835 (e.g., referring to FIG. 8C). As illustrated, thin web 833 may cover the majority of (i.e., at least half of the cross-sectional area of) opening 835, for additional security against over-insertion. Alternatively, thin web 833 may cover only a fraction, for example, about 20% to about 90%, or any ranges therebetween, of the cross-sectional area of opening 835. The web 833 could, in one or more embodiments, cover the entire opening 835. However, covering only part of the opening 835 allows an assembler, as viewing from the distal end 724, to visually confirm when the detonating cord has been fully inserted. For example, thin web 833 may comprise one or more tapered sections 852 or cut-out sections 853 to allow for a line of sight. Thin web 833 may have any suitable shape. The thickness of the thin web 833 (i.e., as measured into the plane of the drawing view) may be selected to provide the desired rigidity, for example, about 0.1 millimeters to about 1 centimeter, or any ranges therebetween. Also as illustrated, the detonator stop 825 is disposed within an opening of the detonator receptacle 728, for example, on the end of the detonator receptacle 728 closest to the proximal end of the detonator housing 320.

Figure 8E:
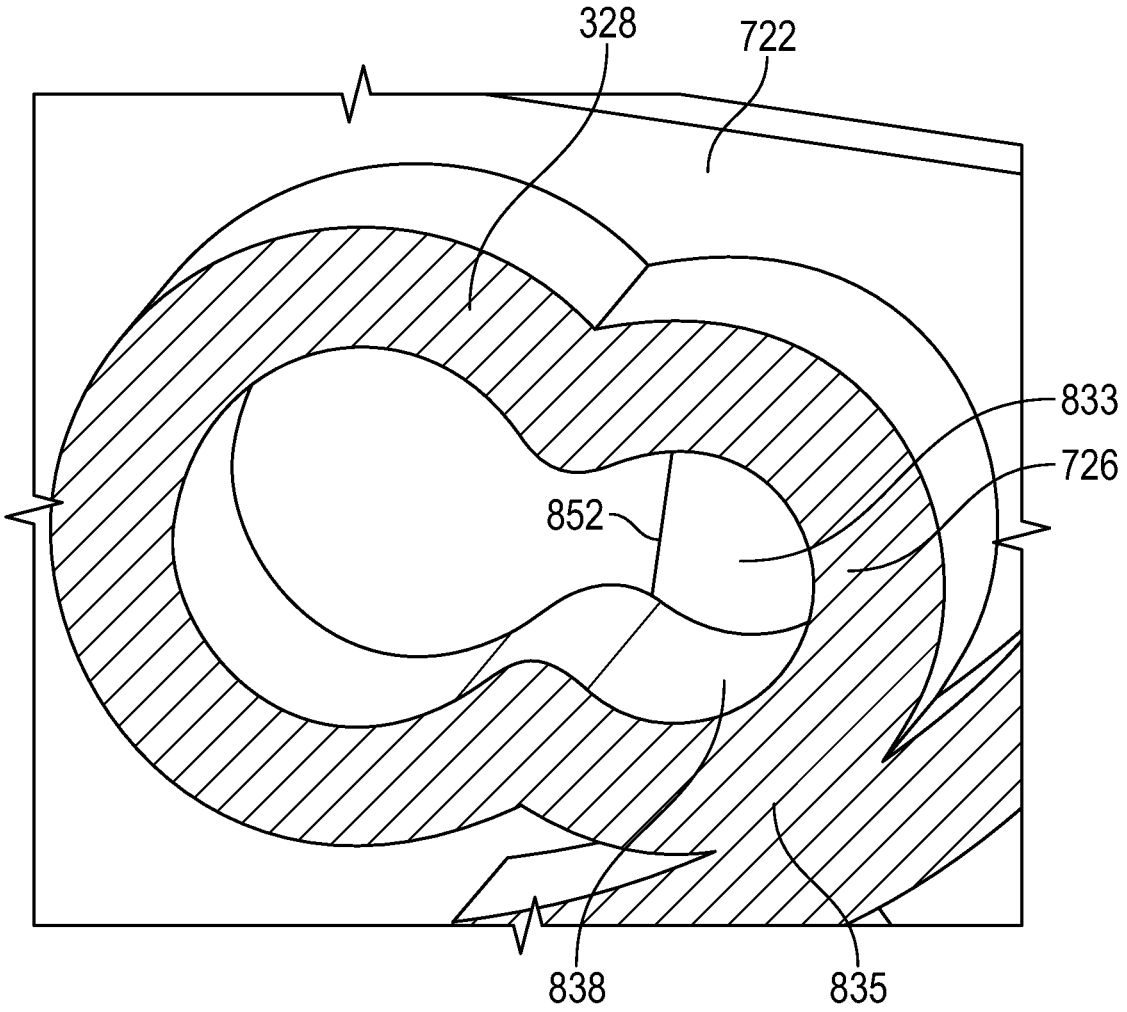
FIG. 8E is an enlarged perspective view of the detonating cord receptacle and detonating cord stop, as viewed from the proximal end of the detonator housing and with the detonating cord omitted for reference, in accordance with some examples of the present disclosure.

FIG. 8E is an enlarged view of the detonator housing 320 as viewed from the proximal end 722 (e.g., inside the gun body) and showing both detonating cord receptacle 726 and detonator receptacle 728, in accordance with one or more examples. This example shows one example configuration of the detonating cord receptacle 726 shown in FIG. 8D wherein the detonating cord stop 831 comprises a thin web 833 extending radially inwardly to cover a majority of the opening 835 of the detonating cord receptacle 726. This thin web 833 covers at least part of the opening sufficient to prevent the detonating cord from being inserted past the thin web 33 in an insertion direction from the proximal end 722 toward the distal end.

As illustrated, the cross-sectional area of detonating cord receptacle 726 is smaller than that of the detonator receptacle 728. This is due to the fact that the circumference of the detonator is larger than the that of the detonator cord 340, and the two are meant to fit snugly against each other in their respective receptacles 726, 728. However, it is contemplated that in the event that detonation is performed with a smaller explosive initiator 362 (e.g., referring to FIG. 3), the cross-sectional area of the detonating cord receptacle 726 may be larger than that of the detonator receptacle 728 to ensure proper side by side detonation. Also, while not illustrated, the one or more ribs 838 shown and described in FIG. 8C may also be present within opening 835 when the thin web 833 is used instead of or in addition to the one or more inward radial protrusion(s) 832A-832E (e.g., referring to FIG. 8C), for providing frictional engagement to the detonator cord 340. Likewise, while not shown, similar ribs may be used within the detonator receptacle 728 to frictionally engage the explosive initiator 362 to ensure reliable seating of the detonator within the detonator housing 320.

The detonator 360 is a part of the explosive train used to trigger an explosion of the perforating charges. The detonator 360 may energize the detonation cord 340 to detonate the upon receiving a detonation signal transmitted downhole to wires 764. For example, the detonation signal may be transmitted down a wireline schematically indicated at 707 to the perforating gun 310*b* from the surface of a wellsite. In the example shown, the detonation signal that arrives at detonator 360 first passes through bulkhead 305*a* of a perforating gun 310*a* disposed uphole from perforating gun 310*b*. The explosive initiator 362 of the detonator 360 received into the detonator receptacle 728 may include a small amount of explosive material responsive to the electric signal. The explosive material may comprise a primary explosive and a secondary explosive. The primary explosive may be extremely sensitive to stimuli, such as an electrical signal in this case. The secondary explosive is typically a larger quantity of less sensitive explosive material that is triggered by the primary explosive. Any suitable explosive material can be used, as a variety of explosive materials for use in detonators are generally available. The overlap L ensures reliable transfer of detonation energy from the detonator 360 to the detonating cord 740. The detonating cord receptacle 726 also limits insertion as further discussed below to prevent further insertion of the detonating cord 740. Even without being able to see the end portion 741 of the detonating cord 740, the assembler can push the detonating cord 740 as far as it will go until it is fully seated, and thus be assured that the detonating cord 740 has been inserted to the intended depth and associated overlap L.

Thus, when the perforating gun 310 is assembled, the string of shaped charges is electrically connected inside the perforating gun bodies with the common detonation cord 340 used to explosively detonate the shaped charges in response to a detonation signal. The detonation cord 340 is connected to the detonator 360 housed in the perforating gun body 316. The detonator 360 may energize the detonation cord 340 to detonate the explosive charges within the respective perforating gun body 316 upon receiving the detonation signal. A separate signal conductor schematically indicated at 770 is formed through each perforating gun body 316*a*, 316*b*. The signal conductors 770 may comprise, for example, a flexible wire, an electric trace, or a ribbon, that is routed along each perforating gun body 316*a*, 316*b* to a signal input on each detonator 360. The signal conductors 770 are interconnected via the connection between each pair of adjacent perforating guns to form a continuous signal path for communicating electrical signals from the wireline 707, along the perforating tool assembly 102, and to each detonator 360. The location of the detonator 360, and the routing of the detonating cord 740 and signal conductors 770 within each perforating gun body 316*a*, 316*b*, are illustrated by way of example and may vary according to the design of the perforating gun selected.

One or more aspects of the present disclosure may be used in various commercial gun systems to increase service quality and reliability of such systems and related products. These features may also be compatible with various third party equipment, may increase the likelihood for a reliable electrical connection downhole, maintain good service quality, and serve to maintain the reputation of established products while reducing non-productive time (NPT) at the work site. Also, as this design may in some examples not rely on additional fasteners, there may also be a potential cost reduction due to the removal of additional external fasteners which would ordinarily be required when designing a perforating gun.

Accordingly, the present disclosure may provide a perforating gun and related apparatus, systems, and methods, which may have improved ergonomics of assembly, material reduction, as well as improved downhole reliability. The methods, systems, and tools may include any of the various features disclosed herein, including one or more of the following statements.

Statement 1: A perforating gun comprising: a gun body; a bulkhead assembly for coupling the perforating gun to an uphole perforating gun, wherein the bulkhead assembly is at least partially disposed in the gun body, and wherein the bulkhead assembly comprises a bulkhead and electrical feedthrough formed in the bulkhead; and a charge tube assembly attached to the bulkhead assembly, wherein the charge tube is disposed in the gun body, and wherein the charge tube assembly comprises a charge tube, a detonator housing interlocked with the charge tube, an end alignment interlocked with the charge tube, and a detonation cord extending from the detonator housing to the charge tube.

Statement 2: The perforating gun of statement 1, wherein the end alignment has a mating notch configured to slide into a corresponding slot on the gun body.

Statement 3: The perforating gun of statements 1 or 2, wherein the end alignment and the detonator housing are made of plastic.

Statement 4: The perforating gun of any of statements 1-3, wherein the detonator housing comprises a detonating cord stop that limits insertion of the detonation cord into the detonator housing.

Statement 5: The perforating gun of any of statements 1-4, wherein the end alignment comprises a lug and a collet that interlock with one or more openings on the charge tube.

Statement 6: The perforating gun of any of statements 1-5, wherein the detonator housing is coupled to the charge tube by one or more snap fit fasteners.

Statement 7: A perforating gun assembly comprising: a first perforating gun comprising a gun body; a bulkhead assembly for coupling the first perforating gun to a second perforating gun, wherein the bulkhead assembly is at least partially disposed in the gun body, and wherein the bulkhead assembly comprises a bulkhead and electrical feedthrough formed in the bulkhead; that is configured to house one or more electrical connections in the perforating gun assembly; an end alignment attached to the bulkhead assembly, wherein the end alignment engages the gun body; a charge tube interlocked with the end alignment, wherein the charge tube holds a plurality of perforating charges disposed in corresponding charge cases; and a detonator housing interlocked with the charge tube; and the second perforating gun comprising: a gun body; a bulkhead assembly for coupling the first perforating gun to a third perforating gun, wherein the bulkhead assembly is at least partially disposed in the gun body, and wherein the bulkhead assembly comprises a bulkhead and electrical feedthrough formed in the bulkhead that is configured to house one or more electrical connections in the perforating gun assembly; an end alignment attached to the bulkhead assembly, wherein the end alignment engages the gun body; a charge tube interlocked with the end alignment, wherein the charge tube holds a plurality of perforating charges disposed in corresponding charge cases; and a detonator housing interlocked with the charge tube, wherein the detonator housing of the second perforating gun is secured in the bulkhead assembly of the first perforating gun.

Statement 8: The perforating gun assembly of statement 7, wherein each end alignment comprises a collet and a lug that interlock with one or more openings of the corresponding charge tube.

Statement 9: The perforating gun assembly of statement 7 or 8, wherein each end alignment comprises one or more protrusions that mate to one or more slots of the corresponding gun body.

Statement 10: The perforating gun assembly of any of statements 7-9, wherein the one or more electrical connections comprise an electrical contact device configured to engage or be engaged by one or more contact pins.

Statement 11: The perforating gun assembly of statement 10, wherein the electrical contact device comprises four or more flexible bends disposed between a contact plate and a support plate.

Statement 12: The perforating gun assembly of statements 10 or 11, wherein each end alignment comprises: narrow and wide portions of the corresponding electrical feedthrough configured to limit side-to-side mobility of the corresponding electrical contact device through contact with one or more fins disposed about a central axis of the corresponding electrical contact device; and at least one material cut-out section for reducing a total volume of space occupied by the end alignments.

Statement 13: The perforating gun assembly of any of statements 7-12, each perforating gun comprising a grounding clip for grounding the detonator housing to the corresponding charge tube, bulkhead, and/or gun body.

Statement 14: The perforating gun assembly of any of statements 7-13, each detonator housing comprising: a detonating cord receptacle having a detonating cord stop; and a detonator receptacle having a detonator stop.

Statement 15: A method comprising: disposing a perforating gun assembly in a wellbore extending into a subterranean formation, wherein the perforating gun assembly comprises at least one perforating gun comprising: a gun body; a bulkhead assembly for coupling the at least one perforating gun to an uphole perforating gun of the perforating gun assembly, wherein the bulkhead assembly is disposed in the gun body, and wherein the bulkhead assembly comprises a bulkhead and electrical feedthrough formed in the bulkhead; that is configured to house one or more electrical connections in the perforating gun assembly; an end alignment attached to the bulkhead assembly, wherein the end alignment engages the gun body; a charge tube interlocked with the end alignment, wherein the charge tube holds a plurality of perforating charges disposed in corresponding charge cases; and a detonator housing interlocked with the charge tube.

Statement 16: The method of statement 15, wherein the end alignment comprises a collet and a lug that interlock with one or more openings on the charge tube.

Statement 17: The method of statements 15 or 16, wherein the detonator housing is coupled to the charge tube by one or more snap fit fasteners.

Statement 18: The method of any of statements 15-17, wherein the end alignment comprises three or more radial protrusions circumferentially spaced about a central axis of the end alignment.

Statement 19: The method of any of statements 15-18, wherein each end alignment comprises one or more cut-out sections for reducing a total volume of space occupied by the one or more end alignments.

Statement 20: The method of any of statements 15-19, further comprising: limiting side-to-side mobility of the electrical connection within the end alignment of the at least one perforating gun by contacting one or more fins disposed about a support plate of one or more electrical contact devices with the electrical feedthrough.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A perforating gun comprising:

a gun body;

a bulkhead assembly for coupling the perforating gun to an uphole perforating gun, wherein the bulkhead assembly is at least partially disposed in the gun body, and wherein the bulkhead assembly comprises a bulkhead and an electrical feedthrough formed in the bulkhead;

a charge tube assembly attached to the bulkhead assembly, wherein the charge tube assembly is disposed in the gun body, and wherein the charge tube assembly comprises a charge tube, a detonator housing interlocked with the charge tube, an end alignment interlocked with the charge tube, and a detonation cord extending from the detonator housing to the charge tube; and an electrical contact comprising a contact plate, a support plate, and three or more bends disposed between the contact plate and the support plate to counteract a force applied to the contact plate when engaged by a contact pin, wherein the electrical contact is configured to convey a detonating signal through the electrical feedthrough extending through the bulkhead assembly, wherein each one of the three or more bends does not extend past a diameter of the support plate to keep the contact plate axially located during deformation from contact with the contact pin.

2. The perforating gun of claim 1, wherein the end alignment has a mating notch configured to slide into a corresponding slot on the gun body.

3. The perforating gun of claim 2, wherein the end alignment and the detonator housing are made of plastic.

4. The perforating gun of claim 3, wherein the detonator housing comprises a detonating cord stop that limits insertion of the detonation cord into the detonator housing.

5. The perforating gun of claim 1, wherein the end alignment comprises a lug and a collet that interlock with one or more openings on the charge tube.

6. The perforating gun of claim 5, wherein the detonator housing is coupled to the charge tube by a collet and a lug snapped into place.

7. A perforating gun assembly comprising:

a first perforating gun comprising a gun body;

a bulkhead assembly for coupling the first perforating gun to a second perforating gun, wherein the bulkhead assembly is at least partially disposed in the gun body, and wherein the bulkhead assembly comprises a bulkhead and an electrical feedthrough formed in the bulkhead; wherein the electrical feedthrough is configured to house one or more electrical connections in the perforating gun assembly;

an end alignment attached to the bulkhead assembly, wherein the end alignment engages the gun body;

an electrical contact that passes through one or more internal regions of the end alignment, wherein the electrical contact comprises a contact plate, a support plate, and three or more bends disposed between the contact plate and the support plate to counteract a force applied to the contact plate when engaged by a contact pin, wherein each one of the three or more bends does not extend past a diameter of the support plate to keep the contact plate axially located during deformation from contact with the contact pin;

a charge tube interlocked with the end alignment, wherein the charge tube holds a plurality of perforating charges disposed in corresponding charge cases; and a detonator housing interlocked with the charge tube; and the second perforating gun comprising:

a gun body;

a bulkhead assembly for coupling the first perforating gun to a third perforating gun, wherein the bulkhead assembly is at least partially disposed in the gun body, and wherein the bulkhead assembly comprises a bulkhead and electrical feedthrough formed in the bulkhead that is configured to house one or more electrical connections in the perforating gun assembly; an end alignment attached to the bulkhead assembly, wherein the end alignment engages the gun body;

a charge tube interlocked with the end alignment, wherein the charge tube holds a plurality of perforating charges disposed in corresponding charge cases; and a detonator housing interlocked with the charge tube, wherein the detonator housing of the second perforating gun is secured in the bulkhead assembly of the first perforating gun.

8. The perforating gun assembly of claim 7, wherein each end alignment comprises a collet and a lug that interlock with one or more openings of the corresponding charge tube.

9. The perforating gun assembly of claim 7, wherein each end alignment comprises one or more protrusions that mate to one or more slots of the corresponding gun body.

10. The perforating gun assembly of claim 7, wherein the one or more electrical connections comprise the electrical contact configured to engage or be engaged by one or more contact pins.

11. The perforating gun assembly of claim 10, wherein the electrical contact comprises four or more flexible bends disposed between a contact plate and a support plate.

12. The perforating gun assembly of claim 11, wherein each end alignment comprises:

at least two different portions of the corresponding electrical feedthrough configured to limit side-to-side mobility of the corresponding electrical contact through contact with one or more fins disposed about a central axis of the corresponding electrical contact; and at least one material cut-out section for reducing a total volume of space occupied by the end alignments.

13. The perforating gun assembly of claim 7, each perforating gun comprising a grounding clip for grounding the detonator housing to the corresponding charge tube, bulkhead, and/or gun body.

14. The perforating gun assembly of claim 7, each detonator housing comprising:

a detonating cord receptacle having a detonating cord stop; and a detonator receptacle having a detonator stop.

15. A method comprising:

disposing a perforating gun assembly in a wellbore extending into a subterranean formation, wherein the perforating gun assembly comprises at least one perforating gun comprising:

a gun body;

a bulkhead assembly for coupling the at least one perforating gun to an uphole perforating gun of the perforating gun assembly, wherein the bulkhead assembly is disposed in the gun body, and wherein the bulkhead assembly comprises a bulkhead and electrical feedthrough formed in the bulkhead; that is configured to house one or more electrical connections in the perforating gun assembly;

an end alignment attached to the bulkhead assembly, wherein the end alignment engages the gun body;

an electrical contact that passes through one or more internal regions of the end alignment, wherein the electrical contact comprises a contact plate, a support plate, and three or more bends disposed between the contact plate and the support plate to counteract a force applied to the contact plate when engaged by a contact pin, wherein each one of the three or more bends does not extend past a diameter of the support plate to keep the contact plate axially located during deformation from contact with the contact pin;

a charge tube interlocked with the end alignment, wherein the charge tube holds a plurality of perforating charges disposed in corresponding charge cases; and a detonator housing interlocked with the charge tube.

16. The method of claim 15, wherein the end alignment comprises a collet and a lug that interlock with one or more openings on the charge tube.

17. The method of claim 15, wherein the detonator housing is coupled to the charge tube by one or more snap fit fasteners.

18. The method of claim 15, wherein the end alignment comprises three or more radial protrusions circumferentially spaced about a central axis of the end alignment.

19. The method of claim 15, wherein each end alignment comprises one or more cut-out sections for reducing a total volume of space occupied by the one or more end alignments.

20. The method of claim 15, further comprising:

limiting side-to-side mobility of the electrical connection within the end alignment of the at least one perforating gun by contacting one or more fins disposed about a support plate of the electrical contact with the electrical feedthrough.

* * * * *